US012193533B2

(12) United States Patent
Hull

(10) Patent No.: US 12,193,533 B2
(45) **Date of Patent: *Jan. 14, 2025**

(54) AMBIDEXTROUS GLOVE HAVING WIDENED GLOVE BODY AND METHOD OF PRODUCING THE SAME

(71) Applicant: Summit Glove Inc., Minerva, OH (US)

(72) Inventor: James L. Hull, Malvern, OH (US)

(73) Assignee: SUMMIT GLOVE INC., Minerva, OH (US)

( * ) Notice: Subject to any disclaimer, the term of this patent is extended or adjusted under 35 U.S.C. 154(b) by 35 days.

This patent is subject to a terminal disclaimer.

(21) Appl. No.: 17/168,418

(22) Filed: Feb. 5, 2021

(65) Prior Publication Data

US 2021/0244112 A1 Aug. 12, 2021

Related U.S. Application Data

(60) Provisional application No. 62/972,727, filed on Feb. 11, 2020.

(51) Int. Cl.
*A41D 19/00* (2006.01)

(52) U.S. Cl.
CPC ..... *A41D 19/0003* (2013.01); *A41D 19/0058* (2013.01); *A41D 19/0082* (2013.01); *A41D 19/001* (2013.01); *A41D 19/0096* (2013.01)

(58) Field of Classification Search
CPC ..... A41D 19/00; A41D 19/0003; A41D 19/0006; A41D 19/001; A41D 19/0044;
(Continued)

(56) References Cited

U.S. PATENT DOCUMENTS 1,097,018 A 5/1914 Hadfield
2,335,871 A 12/1943 Milligan
(Continued)

FOREIGN PATENT DOCUMENTS

WO 199619531 A1 6/1996
WO 2017187209 11/2017

OTHER PUBLICATIONS

"BBQ Gloves—Best Heat Resistant BBQ Gloves" (HowToBBQRight); (Online) <URL: https://howtobbqright.com/ https://www.youtube.com/watch?v=3VKpNXIK4Lo> Apr. 27, 2017 (Apr. 27, 2017) 0:00-2:01.

(Continued)

*Primary Examiner* — F Griffin Hall
(74) *Attorney, Agent, or Firm* — Sand, Sebolt & Wernow Co., LPA

(57) ABSTRACT

A reusable glove for meat processing plants that is able to be easily donned and doffed, and worn over a liner. A thumb crotch is defined between first sides of the glove's index finger region and thumb region. An imaginary first plane extends generally along the index finger region's first side, beyond the thumb crotch, and through the thumb region. An imaginary second plane oriented at right angles to the first plane extends along a narrowest width of the glove's wrist region and intersects the first plane at an intersection region. An imaginary third plane oriented parallel to the first plane and at right angles to the second plane, passes through narrowest width of the wrist region, and intersects the side of the wrist region at a transition region. The transition region is located outwardly beyond the intersection region and vertically below the thumb crotch.

17 Claims, 20 Drawing Sheets

(58) Field of Classification Search
CPC ..... A41D 19/0055; A41D 19/0058; A41D 19/0062; A41D 19/0065; A41D 19/0068; A41D 19/0072; A41D 19/0075; A41D 19/0082; A41D 19/015; A41D 19/0096; A41D 19/04; A41D 19/046; A41D 19/01505; A41D 19/01511; A41D 19/01517; A41D 19/01523; A41D 19/01529; A46B 5/04; A47L 13/18
See application file for complete search history.

(56) References Cited

U.S. PATENT DOCUMENTS

| | | | | |
|---|---|---|---|---|
| 3,197,786 | A * | 8/1965 | Velonis | A41D 19/0062 2/167 |
| 3,633,216 | A | 1/1972 | Schonholtz | |
| 3,867,727 | A | 2/1975 | Povlacs | |
| 3,883,898 | A | 5/1975 | Byrnes, Sr. | |
| 4,388,733 | A | 6/1983 | Anstett | |
| 4,441,213 | A | 4/1984 | Trumble et al. | |
| 4,809,365 | A | 3/1989 | Chen et al. | |
| 4,845,780 | A | 7/1989 | Reimers et al. | |
| 4,884,300 | A | 12/1989 | Vistins | |
| 5,456,354 | A | 10/1995 | Wood | |
| 5,907,870 | A | 6/1999 | Monroe et al. | |
| 6,081,928 | A | 7/2000 | Bourne | |
| 7,356,852 | B2 | 4/2008 | Thai | |
| 7,448,091 | B2 | 11/2008 | Kruss | |
| 8,672,372 | B2 | 3/2014 | Dan | |
| 9,380,794 | B2 | 7/2016 | Hull | |
| 9,635,891 | B2 | 5/2017 | Hull | |
| 9,730,477 | B2 | 8/2017 | Furlong | |
| 9,968,145 | B2 | 5/2018 | Hull | |
| 10,028,542 | B2 | 7/2018 | Hull | |
| 10,238,159 | B2 | 3/2019 | Hull | |
| 10,390,575 | B2 | 8/2019 | Hull | |
| 10,602,787 | B2 | 3/2020 | Hull et al. | |
| 10,602,788 | B2 | 3/2020 | Hull et al. | |
| D890,999 | S | 7/2020 | Hull et al. | |
| 10,750,802 | B2 | 8/2020 | Hull | |
| 10,806,196 | B2 | 10/2020 | Hull | |
| 10,820,639 | B2 | 11/2020 | Hull et al. | |
| 10,820,640 | B2 | 11/2020 | Hull et al. | |
| 10,869,512 | B2 | 12/2020 | Hull et al. | |
| D910,930 | S | 2/2021 | Hull et al. | |
| 10,993,488 | B1 | 5/2021 | Chou | |
| 11,071,338 | B2 | 7/2021 | Hull et al. | |
| 11,172,714 | B2 | 11/2021 | Hull et al. | |
| 11,197,509 | B2 | 12/2021 | Hull et al. | |
| 2004/0092852 | A1 | 5/2004 | Kruss | |
| 2006/0041991 | A1 | 3/2006 | Kim Simm | |
| 2006/0150300 | A1 | 7/2006 | Hassan et al. | |
| 2008/0022436 | A1* | 1/2008 | Hull | A41D 19/0065 2/161.6 |
| 2008/0092261 | A1 | 4/2008 | Yu et al. | |
| 2011/0030121 | A1 | 2/2011 | Smalls | |
| 2012/0036612 | A1* | 2/2012 | Hull | A41D 19/0003 2/163 |
| 2013/0298308 | A1 | 11/2013 | George | |
| 2016/0143379 | A1* | 5/2016 | Hull | A41D 19/0062 2/161.6 |
| 2018/0103701 | A1* | 4/2018 | Hull | A41D 19/0006 |
| 2018/0125132 | A1 | 5/2018 | Wong | |
| 2019/0021571 | A1* | 1/2019 | Mesiti | B32B 3/14 |
| 2019/0191955 | A1* | 6/2019 | Ji | A41D 19/01529 |
| 2019/0357610 | A1 | 11/2019 | Hull et al. | |
| 2020/0170321 | A1 | 6/2020 | Hull et al. | |
| 2020/0170322 | A1 | 6/2020 | Hull et al. | |

OTHER PUBLICATIONS

"BLADESTOP(TM)—Improving Bandsaw Safety for Industry Leading Meat Company" (Scott Automation + Robotics) (online) <URL: https://www.youtube.com/watch?v=53iT81Jsnho> Dec. 5, 2016 (May 12, 2016) 0:00-4:39.

* cited by examiner

AMBIDEXTROUS GLOVE HAVING WIDENED GLOVE BODY AND METHOD OF PRODUCING THE SAME

CROSS-REFERENCE TO RELATED APPLICATIONS

This application claims the benefit of U.S. Patent Application Ser. No. 62/972,727, filed Feb. 11, 2020, the entire disclosure of which is incorporated herein by reference.

BACKGROUND

Technical Field

This disclosure relates generally to gloves. More particularly, this disclosure is directed to a work glove used in industries such as meat packing. Specifically, the glove is provided with a widened wrist region that originates on the thumb region proximate an imaginary horizontal imaginary plane that passes through a lowest part of a thumb crotch region of the glove. The widened wrist region extends downwardly from the imaginary plane all the way to a bottom edge of the wrist region.

Background Information

Gloves are frequently worn in work environments to protect a person's hands. Each glove will have a palm region to cover the person's palm, a back region to cover the back of the person's hand, a thumb region to cover the person's thumb, and finger regions to cover the person's fingers. Each of the thumb region and finger regions extends outwardly away from a top of the palm region and back region and terminates a distance outwardly therefrom in a tip. If an appropriately-sized glove is worn, the circumferences of each of the thumb region and finger regions on a glove will tend to approximate the circumference of the person's thumb or fingers.

Some gloves are configured to terminate slightly below the bottom of the person's hands, i.e., slightly below the bottom of the palm or back of the hand. Other gloves include a wrist region that extends outwardly from the part of the glove that covers the bottom of the palm or back of the hand. The term "wrist region" as used herein depicts that part of the glove which will extend from the base (i.e., the bottom) of the person's hand (i.e., the bottom of the palm and back of the hand) and terminates at an edge or cuff located some distance from the palm region. The wrist region will extend outwardly from the palm region and back region in an opposite direction to the finger regions.

The length of the wrist region on a glove depends upon the use to which the glove is to be put. In some instances, the wrist region will extend downwardly for a few inches from the base of the person's hand and cover some of the person's wrist. In other instances, the wrist region will extend downwardly for several inches from the base of the hand and cover the person's wrist and some or most of the person's forearm. In yet other instances, the wrist region may extend all of the way to proximate the person's elbow.

The materials used to fabricate gloves are selected to specifically provide the glove with particular characteristics that are needed in a particular industry. For example, if the worker is going to be working with high temperature materials, the gloves worn by those workers must offer protection from heat. If the worker is going to be working with toxic chemicals, the gloves worn by those workers must prevent the toxic chemicals from contacting the skin. Yet other gloves are fabricated from materials that will prevent a worker from easily cutting themselves. In each particular industry, the gloves are fabricated from specific materials and are shaped in specific ways to provide the type of protection needed to perform certain tasks.

In industries such as meat packing, meat processing, and chemical processing, it is needful that the worker wearing the gloves be able to maintain their dexterity and readily grip objects. For this reason, gloves used in such environments tend to closely conform to the person's hands and wrists. Additionally, in meat packing and meat processing environments, the gloves need to aid in preventing the person from coming into direct contact with blood and other bodily fluids emanating from the animal carcasses they are handling. The air temperature in meat packing plants is kept relatively cool in order to ensure that the product, i.e., the meat, is kept from spoiling during processing. Because of these very cool conditions, workers tend to get quite cold and therefore want to wear clothing with long sleeves while they work. Since the gloves conform closely to the person's hands, it is difficult for the worker to wear long sleeves while performing their job. The person either has to pull their long sleeves upwardly out of the way of the glove, leaving skin on their wrist or forearm exposed, or they have to pull their sleeves out of the way, put the glove on, and then pull their sleeve back over the top of the wrist region of the glove.

This difficulty in putting a glove on while wearing long sleeves has, to a large extent, contributed to the gloves for environments such as meat processing plants being fabricated with relatively short wrist regions that tend to be quite tight on the wrist. The wrist region on such gloves will tend to lay in direct contact with the skin of the person's wrist so that blood, fat, and other bodily fluids will not be able to easily enter the interior of the glove. Similar types of gloves are used in chemical processing plants for very similar reasons.

When a person is wearing a glove with a closely conforming, slightly shorter wrist region and wants to wear a long sleeved shirt then that sleeve typically has to be pulled down over an exterior surface of the wrist region. This may lead to blood, fat, bodily fluids in a meat processing plant, or chemicals in a chemical processing plant soaking into the worker's sleeves, contaminating the same. In other instances, the worker's sleeves may inadvertently contact the meat being processed, for example, and pass contaminants from the sleeves to the meat.

If the glove is provided with an even shorter wrist region, say one to two inches long, this may enable the worker to wear long sleeved clothing without covering the exterior surface of the glove's wrist region, the shortened wrist region may tend to cause other problems. For example, in meat packing and chemical processing plants, the shorter wrist region may leave much of the skin of the worker's wrist and the forearm unprotected by glove material. This arrangement can lead to injury if toxic chemicals contact the worker's skin or can lead to cross-contamination of the product and the person's skin. It would seem that making the gloves longer would help solve this problem but then the person's long sleeves on their clothing or a lab coat may accidentally contact the blood, fat, bodily fluids, toxic or corrosive chemicals and soak those materials up as described earlier herein.

Another problem with previously known gloves of the type described above is that, because they conform closely to the hand, they typically are quite difficult to pull on and equally difficult to take off. When it is desired to pull the glove on or off the lower portion of the wrist region needs to be grasped and pulled on (i.e., donned) in order to draw the glove onto the hand or off of the hand. If the glove is on the hand and needs to be removed then grasping the lower portion of the wrist region with bloodied, contaminated, or chemical-covered fingers may cause the fingers to come into direct contact with the skin on the worker's wrist. This direct skin contact may contaminate the person's skin and/or cause harm to the person if the finger regions of the glove are covered in toxic chemicals. Often, when these types of gloves are taken off, the glove material becomes inverted as the person struggles to remove them from their hand. It is then unwise to try and turn the glove the right way out so that the glove may be reused as this will bring the worker into direct contact with the contaminants that are now in the interior of the glove. Frequently when such gloves are removed, the glove material will tear because the person's fingers suddenly increase the circumference of the lower portion of the wrist region beyond its ability to stretch. For all these reasons and more, once the glove has been used, it typically has to be discarded after the worker has removed it from their hand.

If the worker works a full eight hour shift, for example, a pair of gloves will need to be donned at the beginning of the worker's shift, then removed, and thrown away when the worker goes on a morning break. Another pair of gloves will have to be donned when the worker returns from their morning break and that second pair of gloves will be removed and discarded when the worker breaks for lunch. A third pair of gloves will need to be donned when the worker returns from lunch and that third pair will be removed and discarded when the worker goes on a second break or leaves to go home. In many instances, a perfectly good, undamaged pair of gloves will have to be thrown away. This situation is extremely costly to the owner of the meat processing plant or chemical plant and is furthermore extremely bad for the environment because all gloves used in these situations are, of necessity, single-use gloves.

SUMMARY

The glove disclosed herein provides solutions to the problems experienced with PRIOR ART gloves in industries such as meat processing and chemical processing. The glove according to the present disclosure is configured in such a way that the glove may be donned at the beginning of a shift, removed when the worker goes on a morning break, put back on at the end of the morning break, removed when the worker goes to lunch, put back on when the worker returns from lunch, removed when the worker goes for a second break, and put back on when the worker returns from the second break. At the end of the workers shift, e.g. at the end of the eight-hour shift, the gloves are removed for a final time and are then discarded for sanitary reasons. Obviously, if one or both gloves becomes damaged at some time during the worker's shift, the damaged glove(s) will the thrown away. Because each worker in the plant is able to use only one pair of gloves per shift instead of using multiple pairs of glove per shift, the amount of glove garbage produced by a single processing plant is cut down substantially. This is advantageous to the owner of the processing plant and is good for the environment because of the drastic reduction in glove usage at that processing plant.

Additionally, the glove in accordance with the present disclosure is an ambidextrous glove, i.e., can be worn on either of the left hand or the left hand of the worker. When one glove is damaged, the glove for the other hand does not need to be automatically thrown away when hand-specific gloves are used. As such, the glove in accordance with the present disclosure is a multi-use ambidextrous glove which further greatly reduces the overall cost to the owner of the plant in which the gloves are used. Use of gloves in accordance with the present disclosure therefore greatly reduces the carbon footprint for the industry at large and is therefore far better for the environment than previously-known gloves used in the same industry.

Additionally, from a worker's point of view, the glove in accordance with the present disclosure is configured in such a way that the worker may wear long sleeves that cover the skin on their wrist and forearm but the gloves are configured to be able to extend over the outside of the worker's long sleeves, protecting their clothing from contamination. The glove in accordance with the present disclosure is also easier to remove and can be pulled off from (i.e., doffed) the hand by grasping the fingertip regions of the glove and pulling the glove away from over the fingers. The glove in accordance with the present disclosure therefore do not invert when they are removed and the worker will not bring their bloodied or chemical-contaminated fingers into contact with their skin or with their clothing.

Still further, the gloves in accordance with the present invention enable the worker to wear a liner under the glove and can pull the glove on or off the liner-covered hands several times during a work shift. So, for example, a worker can place a cut-resistant liner or a thermally-insulating liner directly on their hands and pull the glove in accordance with the present disclosure over the cut-resistant liner or the thermally-insulating liner. This ability greatly enhances the worker's safety and the quality of the worker's time spent in the plant. Furthermore, because workers can wear long sleeves and cover the skin on their wrist and forearm, the gloves greatly reduce the chance that the worker will come into direct contact with contaminating or toxic substances on the job. Safety and comfort is therefore enhanced by the provision of the gloves in accordance with the present disclosure.

In one aspect, an exemplary embodiment of the present disclosure may provide a glove comprising a body defining an interior cavity adapted to receive a person's hand therein; wherein the body includes a thumb region adapted to receive the person's thumb therein; an index finger region adapted to receive the person's index finger therein, wherein the index finger region has a first side that together with a first side of the thumb region defines a thumb crotch therebetween; a wrist region adapted to receive the person's wrist therein; an imaginary first plane extending generally along the first side of the index finger region, downwardly beyond the thumb crotch, and through the thumb region; an imaginary second plane oriented at right angles to the imaginary first plane and extending along a narrowest width of the wrist region, wherein the imaginary first plane and imaginary second plane intersect one another at an intersection region; and an imaginary third plane oriented parallel to the imaginary first plane and at right angles to the imaginary second plane, said imaginary third plane passing through narrowest width of the wrist region; wherein the imaginary second plane intersects a first side of the wrist region at a transition region; and wherein the transition region is located outwardly from the intersection region in a direction moving away from the imaginary third plane and towards the imaginary first plane.

In another aspect, an exemplary embodiment of the present disclosure may provide in combination a liner adapted to closely conform to a person's hand; and a glove selectively placeable over the liner and removable from over the liner; wherein the glove comprises a body defining an interior cavity adapted to receive a person's hand therein; wherein the body includes a thumb region adapted to receive the person's thumb therein; an index finger region adapted to receive the person's index finger therein, wherein the index finger region has a first side that together with a first side of the thumb region defines a thumb crotch therebetween; a wrist region adapted to receive the person's wrist therein; an imaginary first plane extending generally along the first side of the index finger region, downwardly beyond the thumb crotch, and through the thumb region; an imaginary second plane oriented at right angles to the imaginary first plane and extending along a narrowest width of the wrist region, wherein the imaginary first plane and imaginary second plane intersect one another at an intersection region; and an imaginary third plane oriented parallel to the imaginary first plane and at right angles to the imaginary second plane, said imaginary third plane passing through narrowest width of the wrist region; wherein the imaginary second plane intersects a first side of the wrist region at a transition region; and wherein the transition region is located outwardly from the intersection region in a direction moving away from the imaginary third plane and towards the imaginary first plane.

In another aspect, an exemplary embodiment of the present disclosure may provide a method of using a glove in a processing operation, said method comprising steps of selecting an appropriately-sized glove for a person's hand, wherein the glove comprises a body defining an interior cavity for receiving the person's hand, wherein the body includes a thumb region, an index finger region having a first side that together with a first side of the thumb region defines a thumb crotch therebetween, and a wrist region, an imaginary first plane extending generally along the first side of the index finger region, downwardly beyond the thumb crotch, and through the thumb region; an imaginary second plane is oriented at right angles to the imaginary first plane and extending along a narrowest width of the wrist region, wherein the imaginary first plane and imaginary second plane intersect one another at an intersection region; and an imaginary third plane is oriented parallel to the imaginary first plane and at right angles to the imaginary second plane, said imaginary third plane passing through narrowest width of the wrist region; wherein the imaginary second plane intersects a first side of the wrist region at a transition region; and wherein the transition region is located outwardly from the intersection region in a direction moving away from the imaginary third plane and towards the imaginary first plane; inserting the person's hand into the interior cavity of the body; spacing at least the person's wrist a distance away from an interior surface of the wrist region; performing a task while wearing the glove; and removing the glove after performing of the task.

In another aspect, an exemplary embodiment of the present disclosure may provide a glove comprising a body defining an interior cavity adapted to receive a person's hand and wrist therein; wherein the body includes a palm region and a back region opposed to the palm region; a thumb region and a finger region extending outwardly from the palm region and the back region, wherein the finger region includes an index finger region having a first side that together with a first side of the thumb region defines a thumb crotch therebetween; a wrist region extending downwardly from the palm region and the back region, said wrist region having a narrowest width that extends between a first side of the wrist region and a second side of the wrist region; an imaginary first plane extending generally along the first side of the index finger region, downwardly beyond the thumb crotch, and through the thumb region; and an imaginary second plane oriented at right angles to the imaginary first plane and extending along the narrowest width of the wrist region; wherein the imaginary second plane intersects the imaginary first plane at an intersection region; an imaginary third plane is oriented parallel to the imaginary first plane and at right angles to the imaginary second plane, said imaginary third plane passing through narrowest width of the wrist region; and wherein the imaginary second plane intersects the wrist region's first side at a transition region; and wherein the transition region is located on an opposite side of the imaginary first plane from the imaginary third plane. In one embodiment, the transition region is located vertically below the thumb crotch.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
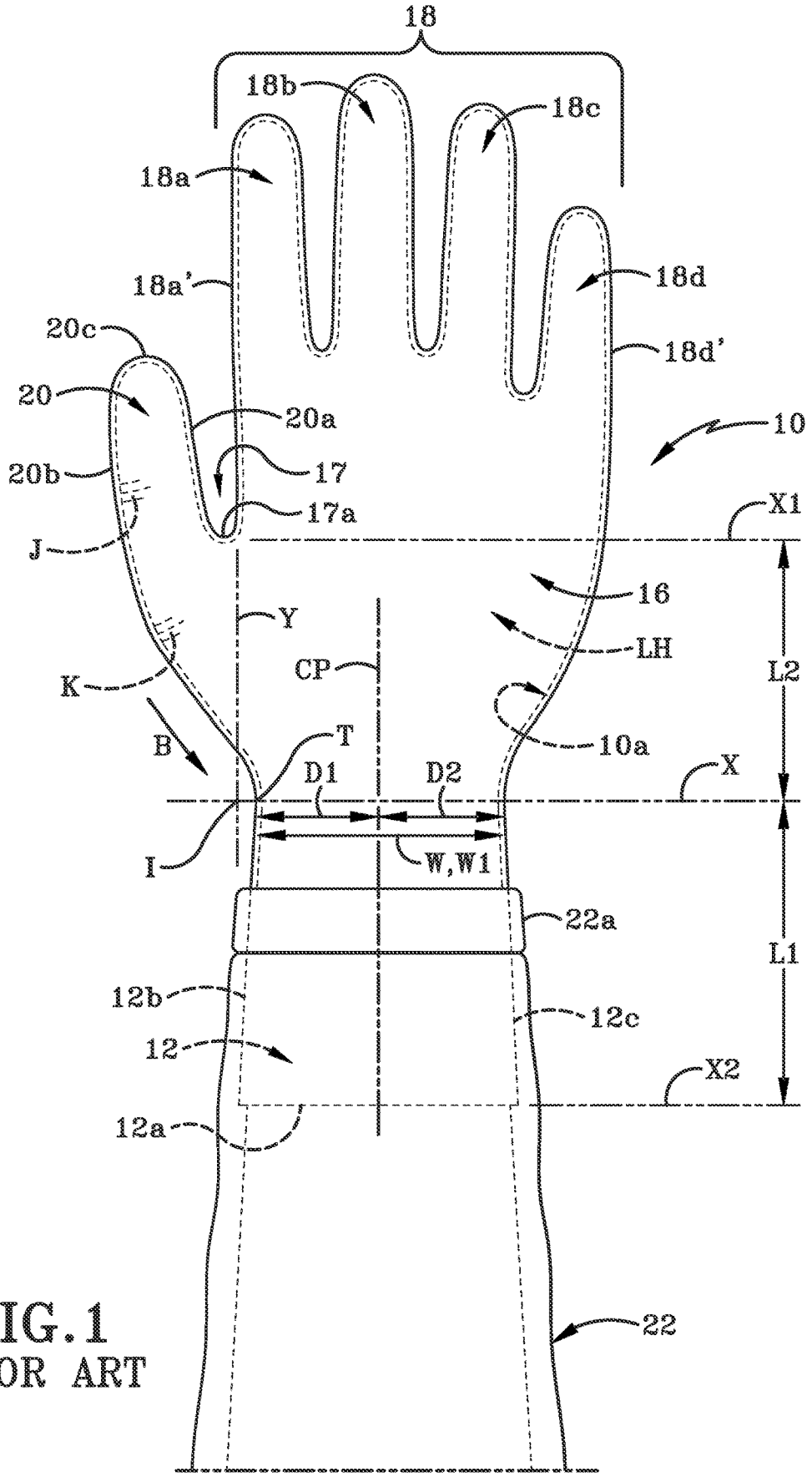
FIG. 1 PRIOR ART
FIG. 1 is a front elevation view of a PRIOR ART ambidextrous glove, showing a person's left hand in phantom within the glove.

When a person is going to perform a task that requires wearing gloves, they will first select a size of glove that is complementary to their hand. If the glove they select is too small, one or more of the finger region, the thumb region, the palm region, the back region, and the wrist region will be tight and constricting on the person's hand. The too-small glove may also interfere with the person's ability to pick up and grip or hold objects and the person's dexterity will tend to be adversely affected. If the glove the person selects is too large, one or more of the finger regions, the thumb region, the palm region, the back region, and the wrist region will be loose and baggy on the person's hand. Apart from other issues, wearing a too-large glove will tend to result in extra glove material extending beyond the tips and sides of the fingers and/or thumb. This extra material will tend to interfere with the person's dexterity and small motor skills so that they cannot easily pick up objects. Extra material may also cause one finger to overlap the extra material from an adjacent finger and trap that extra material between the hand and an object being held. The trapped material will tend to prevent the person from making a first properly as the fingers cannot move naturally, thus reducing the person's ability to grip objects. A correctly-sized glove, on the other hand, will be comfortable to wear. The glove will not be too tight or too loose, there will be sufficient material for the person's fingers and thumbs to move naturally and for the person to be able to clench and release their fist, without the glove tightening uncomfortably around their hand. Additionally, there will be little to no extra material extending beyond the person's fingertips and so their dexterity will be relatively unhindered by the glove.

The most commonly suggested methodology for selecting an appropriately-sized or correctly-sized glove is that the person should take their dominant hand (i.e., the left hand if the person is right-handed) and wrap a tape measure around that hand at the widest point (usually around the region that includes the knuckles at the base of the fingers). The tape measure should fit loosely around this widest region. The measurement indicated on the tape measure should be noted and then rounded up to the nearest inch. The "nearest inch" is the size of the appropriately-sized or correctly-sized glove for the person's hand. A 6" glove is frequently been referred to in the industry as an "X-Small" glove, a 7" as a "Small" glove, an 8" as a "Medium" glove, a 9" as a "Large" glove, a 10" as an "X-Large" glove, and an 11" as an "XX-Large" glove. Gloves may be smaller or larger than the aforementioned measurements and named differently. For example a 12" glove may be referred to in the industry as an "XXX-Large" glove. Throughout this description, it is presumed that a person or person will select the complementary-sized, correctly-sized, or appropriately-sized glove for their hand and will not be selecting a glove size for use that would typically be considered too small or too large for their hands. The correct glove size for a person's hand will be referred to herein as an "appropriate" glove size, a "correct" glove size, or a "complementary" glove size.

Figure 2A:
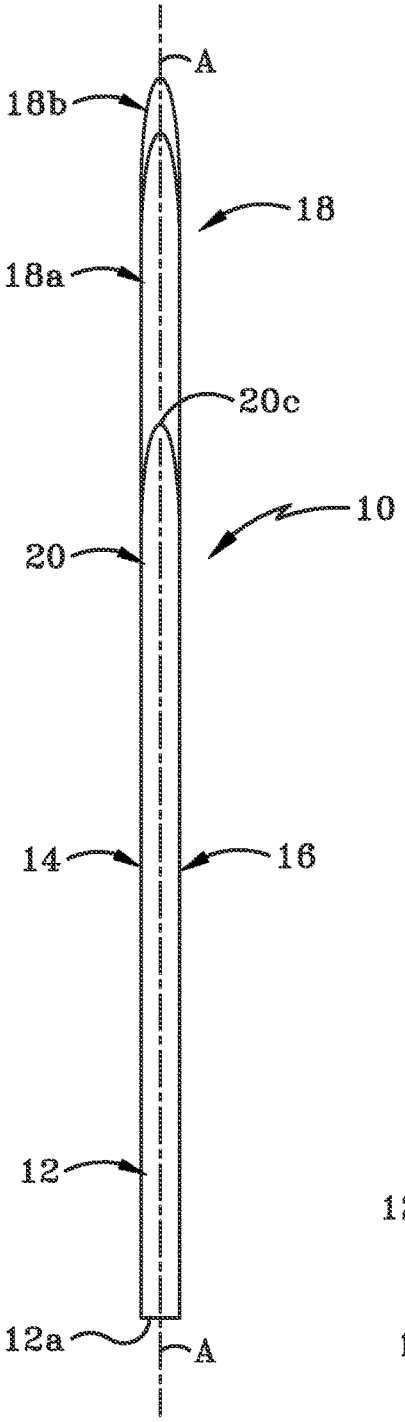
FIG.2A PRIOR ART
FIG. 2A is a left side elevation view of the PRIOR ART ambidextrous glove shown on its own without the person's hand received within the glove interior.
Figure 2B:
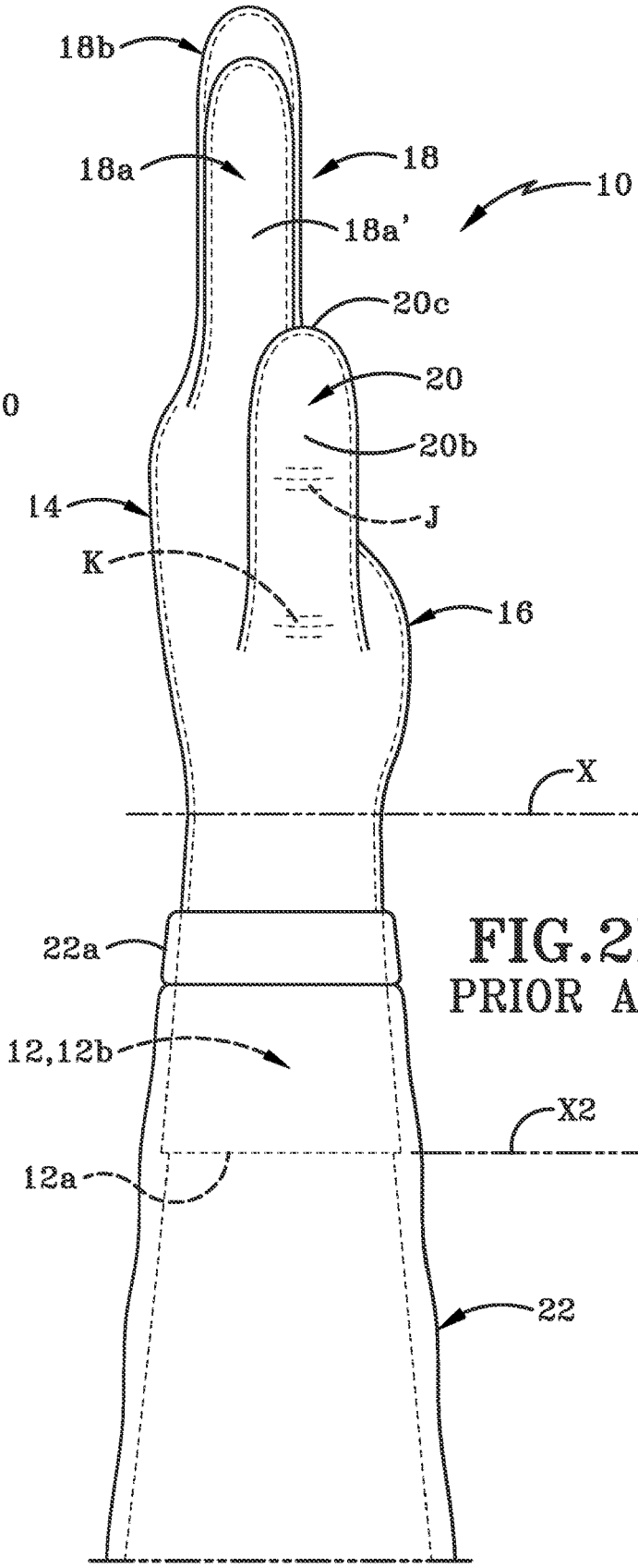
FIG.2B PRIOR ART
FIG. 2B is a left side elevation view of the PRIOR ART ambidextrous glove shown in FIGS. 1 and 2A showing the person's hand in phantom within the glove interior.

Referring now to FIGS. 1 and 2 a PRIOR ART glove 10 is shown worn on a person's left hand. The person's left hand is generally indicated herein by the reference character "LH". The person's left hand "LH" is shown in phantom within a hollow interior cavity 10*a* defined by the PRIOR ART glove 10. PRIOR ART glove 10 includes a wrist region 12, a back region 14, a palm region 16 (FIG. 2), finger regions 18, and a thumb region 20. When PRIOR ART glove 10 is worn, the wrist region 12 will circumscribe the person's wrist and possibly a part of the person's forearm; the back region 14 and palm region 16, together, will circumscribe the person's palm and back of their hand "LH"; the finger regions 18 will each circumscribe one of the person's fingers, and the thumb region 20 will circumscribe the person's thumb.

It will be understood that PRIOR ART glove 10 when selected for use by any particular person will be selected in an appropriate size for that person's hand. FIG. 1 shows approximately where a person's thumb joint "J" will be located in thumb region 20 when the appropriately-sized PRIOR ART glove 10 is worn on the person's left hand. The figure also shows generally where the person's knuckle "K" will be located at the base of the person's thumb when the appropriately-sized PRIOR ART glove 10 is worn.

The finger region 18 includes an index finger region 18*a*, a middle finger region 18*b*, a ring finger region 18*c*, and a little finger region 18*d* that will, respectively, receive the person's index finger, middle finger, ring finger, and little finger. A thumb crotch region 17 is defined between a first surface 18*a*' of the index finger region 18*a* and a first surface 20*a* of the thumb region 20. A lowest part of the thumb crotch region 17 is indicated by the reference number 17*a*.

The thumb region 20 is shown as including a second surface 20*b* that is opposed to the first surface 20*a*. The thumb region 20 includes a tip 20*c* where the first and second surfaces 20*a*, 20*b* meet. FIG. 1 shows that wrist region 12 has a bottom edge 12*a* that the reader will understand circumscribes an opening (not shown) to an interior cavity 10*a* defined by the PRIOR ART glove 10. Wrist region 12 further includes a first side 12*b* and a second side 12*c* that extend upwardly from bottom edge 12*a* towards the second side 20*b* of thumb region 20 and towards an outer side 18*d*' of little finger region 18*d*, respectively.

PRIOR ART glove 10 is illustrated as being an ambidextrous glove worn on a person's left hand "LH". An ambidextrous glove is a glove that is configured to be worn one either of a person's left hand or left hand. A hand-specific glove, by contrast, can only be worn on a person's left hand or on their left hand. What makes PRIOR ART glove 10 an ambidextrous glove is that the thumb region 20 and finger regions 18 are all aligned along a common imaginary plane, shown in FIG. 2A as imaginary plane "A". In hand-specific gloves, by contrast, the finger regions will all be aligned along a common imaginary plane similar to imaginary plane "A" but the thumb region will not be located in that common imaginary plane but will instead be located in a different imaginary plane that is displaced forwardly of imaginary plane "A" in a direction moving towards a front surface of the glove's palm region.

Still referring to FIG. 1, three imaginary planes "X", "X1", and "X2" are marked on the illustrated PRIOR ART glove 10. The three imaginary planes "X", "X1", and "X2" are horizontally-oriented (with respect to the manner in which the PRIOR ART glove 10 is illustrated in FIG. 1) and are arranged parallel to one another. The imaginary planes "X", "X1", and "X2" are all oriented at right angles to the common imaginary plane "A" (FIG. 2A). The narrowest width "W" of wrist region 12 of PRIOR ART glove 10 extends along imaginary plane "X". Imaginary plane "X" will be positioned slightly below a bottom of the person's hand "LH" when PRIOR ART glove 10 is worn. Imaginary plane "X1" runs through the lowest region of the thumb crotch 17*a*. Imaginary plane "X2" runs along the bottom edge 12*a* of the wrist region 12. The region of the PRIOR ART glove 10 located between the imaginary plane "X" and the imaginary plane "X2" comprises substantially all of the wrist region 12 of PRIOR ART glove 10.

Still referring to FIG. 1, two additional imaginary planes "Y" and "CP" are marked on the illustrated PRIOR ART glove 10. Imaginary planes "Y" and "CP" are oriented generally parallel to one another and at right angles to imaginary planes "X", "X1" and "X2". Imaginary plane "Y" extends generally along the first side 18*a*' of index finger 18*a* passing through thumb crotch 17*a*. Imaginary plane "CP" is a central plane that indicates a center of the width "W".

Still referring to FIG. 1, imaginary plane "Y" intersects with imaginary plane "X" at an intersection indicated by reference character "I". Imaginary plane "Y" also intersects with the region of the PRIOR ART glove 10 extending downwardly from second side 20*b* of thumb region towards wrist region 12 in the direction indicated by arrow "B". The region where imaginary plane "X" intersects with the side wall 12*b* of the wrist region 12 of the PRIOR ART glove 10 is identified as the transition region "T". As is evident from FIG. 1, the transition region "T" is located inwardly of the intersection region "I" between imaginary planes "Y" and "X". In other words, the transition region "T" is therefore located in a zone extending between imaginary planes "Y" and "CP".

PRIOR ART gloves 10 used in the meat packing industry typically are about 300 mm in length from a tip of the middle finger region 18*b* to bottom edge 12. The relative distance from the bottom edge 12*a* of wrist region 12 to the imaginary plane "X" that passes through the narrowest width "W" is indicated in FIG. 1 as "L1". The relative distance from the imaginary plane "X" that passes through the narrowest width "W" to the imaginary plane "X1" that passes immediately below the thumb crotch 17*a* is indicated in FIG. 1 as "L2". Length "L1" for PRIOR ART gloves 10 used in the meat packing industry may be in the range of from about 80 mm up to about 100 mm. Length "L2" for PRIOR ART gloves 10 used in the meat packing industry may be in the range of from about 75 mm up to about 85 mm. These dimensions "L2" and "L2" will be discussed further later herein.

The narrowest width "W" of the wrist region 12 of PRIOR ART glove 10 may be measured when the glove is laid flat on a flat surface. The measured width "W" will be equal to approximately half of the circumference of wrist region 12 along imaginary plane "X". In PRIOR ART gloves 10 fabricated in sizes 6 through 10 used in the meat packing industry, the narrowest width "W" is in the range of from about 85 mm up to about 100 mm. In other words, the circumference of size 6 to 10 PRIOR ART gloves 10 along imaginary plane "X" is in the range of from about 170 mm up to about 200 mm. The width of the bottom end 12*a* of the wrist region of size 6 to size 10 PRIOR ART glove 10 (when laid flat on a surface) is in the range of from about 100 mm up to about 110 mm. In other words, the circumferences of the bottom end 12*a* of the size 6 to 10 PRIOR ART gloves 10 is in the range of from about 200 mm up to about 220 mm. It will be readily understood that the wrist region 12 of PRIOR ART glove 10 therefore flares outwardly to a slight degree from the narrowest width "W' along imaginary plane X" to bottom end 12*a* of wrist region 12 extending along imaginary plane "X2". This will be discussed further later herein.

The distance between the imaginary center plane "CP" and the first side 12*b* of the wrist region 12 taken along imaginary plane "B" is indicated as "D1" and the distance between imaginary center plane "CP" and the second side 12*c* of wrist region 12 is indicated as "D2". "D1" plus "D2" equals the width "W" of PRIOR ART glove 10. "D1" and "D2" are substantially equal in size. "D1" and therefore "D2" are in the range of from about 42.5 mm up to about 50 mm in size 6 to 10 PRIOR ART gloves 10.

PRIOR ART glove 10 is fabricated in such a way that the material of the glove will closely conform to the shape and size of the person's hand and wrist. Effectively, an appropriately-sized PRIOR ART glove 10 for a worker will fit snugly around the person's fingers, thumb, palm, back of the hand, and their wrist. In particular, as illustrated in FIG. 1, the narrowest portion of wrist region, i.e., width "W" is substantially the same as the narrowest region of the person's wrist which is indicated as "W1".

In most people, the part of their wrist that is located immediately adjacent the bottom of their hand is of a smaller circumference than the rest of their wrist and forearm. Since wrist region 12 of PRIOR ART glove 10 flares only slightly in width from the narrowest width "W" in a direction moving towards the bottom edge 12*a* of wrist region 12, when the PRIOR ART glove 10 is pulled onto the person's hand and over their wrist, the material of the PRIOR ART glove 10 will become relatively closely conformed to the person's wrist which extends beyond imaginary plane "X".

The width of wrist region 12 may be stretched to conform to the circumference of the person's wrist and first part of their forearm.

When PRIOR ART glove 10 is to be donned or pulled on, the person will insert their hand "LH" through an opening bounded and defined by the bottom edge 12*a* of the wrist region and into an interior 10*a* of the PRIOR ART glove 10. FIGS. 1 and 2 show that the PRIOR ART glove 10 closely conforms to the shape of the person's hand "LH" and wrist. Essentially, the material of the PRIOR ART glove 10 directly contacts the person's skin. Because the wrist region 12 of the PRIOR ART glove 10 approximates the circumference of the person's wrist, if the person is wearing clothing that has long sleeves, the wrist region 12 of glove 10 cannot be easily pulled over a portion of a sleeve 22 that circumscribes the person's wrist. Consequently, the person will have to pull the sleeve 22 upwardly along their arm and away from their hand to the point that a sleeve cuff 22*a* on the sleeve 22 is spaced a distance away from the bottom edge 12*a* of the wrist region 12 when the PRIOR ART glove 10 is being pulled on. Once the PRIOR ART glove 10 is correctly positioned on the person's hand and wrist, the person may pull their long sleeve 22 downwardly over at least a portion of the exterior surface of the wrist region 12 of glove 10 as shown in FIG. 1. Part of the sleeve 22 will therefore overlap the portion of the wrist region 12. Sleeve cuff 22*a* of sleeve 22 will end up being located in close proximity to the bottom of the person's hand and thereby close to the imaginary plane "X" shown in FIG. 1. The person is the PRIOR ART glove 10 is therefore at risk of contacting the product with which the person is working. So, for example, if the person is a meat packer and is processing meat, the sleeve cuff 22*a* and part of the sleeve 22 may become soaked with blood or other bodily fluids and/or come into contact with the meat. If the person is handling chemicals of some type, those chemicals may transfer onto the sleeve cuff 22*a* and/or part of the sleeve 22. The sleeve 22 may therefore become contaminated by the chemicals the person is handling. Alternatively, or additionally, substances on the sleeve 22 may be transferred to the chemicals the person is working with and may thereby contaminate the product.

If after working for a period of time the person wishes to remove PRIOR ART glove 10, the person will have to pull the lower part of their sleeve 22 upwardly and out of the way in order to be able to grasp the bottom edge 12*a* of wrist region 12. So, even if the sleeve cuff 22*a* of shirt sleeve 22 had not been previously contaminated, because the person now has to handle the sleeve 22 to try and remove glove 10, the sleeve 22 may now become contaminated. Additionally, there is a strong likelihood that the finger regions 18 and thumb region 20 of the PRIOR ART glove 10 on the other of the person's hands will accidentally contact the person's skin on their wrist of the hand from which the PRIOR ART glove 10 is being removed. The finger regions 18 and thumb region 20 of the other glove may accidentally cause the person's skin to be contaminated with blood, bodily fluids, or chemicals, depending on the industry in which the person is working.

Additionally, because the wrist region 12 closely approximates the width of the person's wrist, as PRIOR ART glove 10 is being pulled off the person's hand "LH", it is highly likely the glove 10 will become reversed or inverted during removal. In other words, the interior surface of the PRIOR ART glove 10 will become the outside of the glove and the exterior surface of the PRIOR ART glove 10 will become the inside of the glove. The PRIOR ART glove 10 will then have to be discarded because the person cannot handle the glove 10 to turn it right side out again without their fingers becoming contaminated with the substances that are now on the inside of the glove.

Still further, removing PRIOR ART glove 10 is very likely to result in the wrist region 12 being damaged as the person tries to pull the narrow width wrist region 12 over the rest of their hand. Any such damage will mean that the PRIOR ART glove 10 very likely has to be thrown away after a single use.

A first embodiment of a glove in accordance with the present disclosure is illustrated in FIGS. 3A through 4B, and is generally indicated at 150. Glove 150, as illustrated is an exemplary Size 10 glove in accordance with an aspect of the present disclosure. It will be understood that the following description applies equally to all sizes of glove 150 fabricated in accordance with the present disclosure.

Glove 150 has a body comprising a wrist region 152, a back region 154, a palm region 156 (FIG. 46), finger regions 158, and a thumb region 160. Back region 154 and palm region 156 are interposed, i.e., located between, the wrist region 152 and the finger and thumb regions 158, 160. The interior surface of the body of the glove 150 bounds and defines an interior cavity 150*a* (FIG. 3A) into which a person's hand is received. A person's left hand "LH" is shown in phantom in FIGS. 3A and 4B received within interior 150*a* of the glove's body. When glove 150 is worn, the wrist region 152 will circumscribe the person's wrist and possibly a part of the person's forearm; the back region 154 and palm region 156, together, will circumscribe the person's palm and back of their hand. The finger region 158 includes an index finger region 162, a middle finger region 164, a ring finger region 166 and a little finger region 168. The finger regions 158 are configured to circumscribe the person's index finger, middle finger, ring finger, and little finger, respectively, when glove 150 is worn. The thumb region 160 is configured to circumscribe the person's thumb when the glove 150 is worn.

Figure 3A:
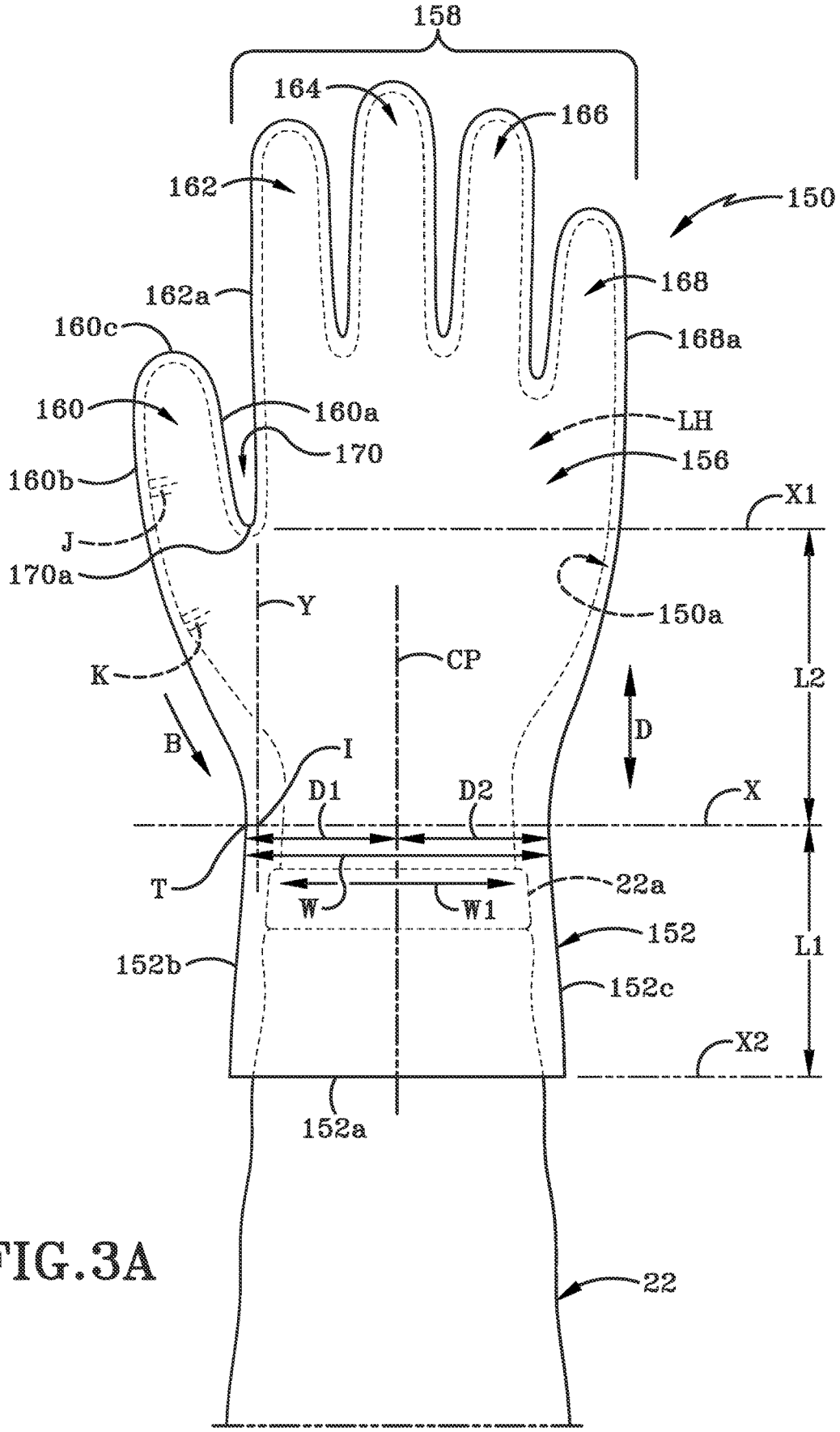
FIG. 3A is a front elevation view of a glove in accordance with an aspect of the present disclosure, showing a person's hand in phantom within the glove interior, and showing the glove material spaced a distance away from the person's skin, and showing a long sleeve worn by the person being covered by the glove's widened wrist region.

In FIG. 3A, a thumb crotch region 170 of glove 150 is defined between a first surface 162*a* of the index finger region 162 and a first surface 160*a* of the thumb region 160. The thumb region 160 also includes a second surface 160*b* that is opposed to the first surface 160*a*. The thumb region 160 includes a tip 160*c* where the first and second surfaces 160*a*, 160*b* meet. A lowest part of the thumb crotch region 170 is indicated by the reference number 170*a*. The thumb crotch region 170 is configured to contact a thumb crotch of the person's hand or to be located proximate thereto when the glove 150 is worn. In other words, the thumb crotch region 170 will be position adjacent the part of the person's hand located between the person's thumb and index finger.

FIG. 3A shows wrist region 152 having a bottom edge 152*a* that the reader will understand circumscribes an opening (not shown) to interior cavity 150*a* of glove 150. Wrist region 152 further includes a first side 152*b* and a second side 152*c* that extend upwardly from bottom edge 152*a* towards the second side 160*b* of thumb region 160 and towards an outer side 168*a*' of little finger region 168, respectively.

Figure 4A:
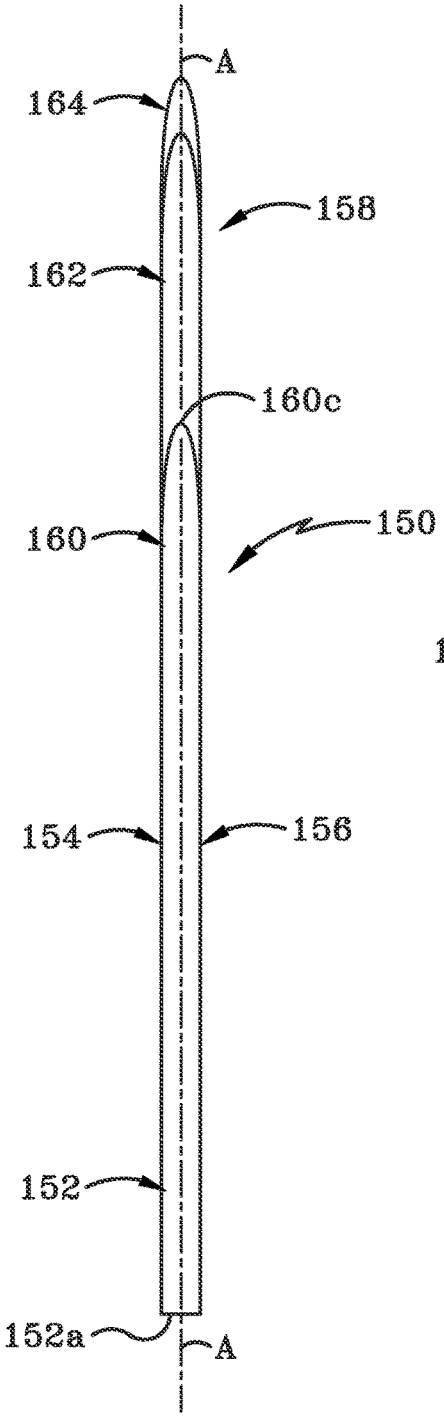
FIG. 4A is a left side elevation view of the PRIOR ART ambidextrous glove shown on its own without the person's hand received within the glove interior.
Figure 4B:
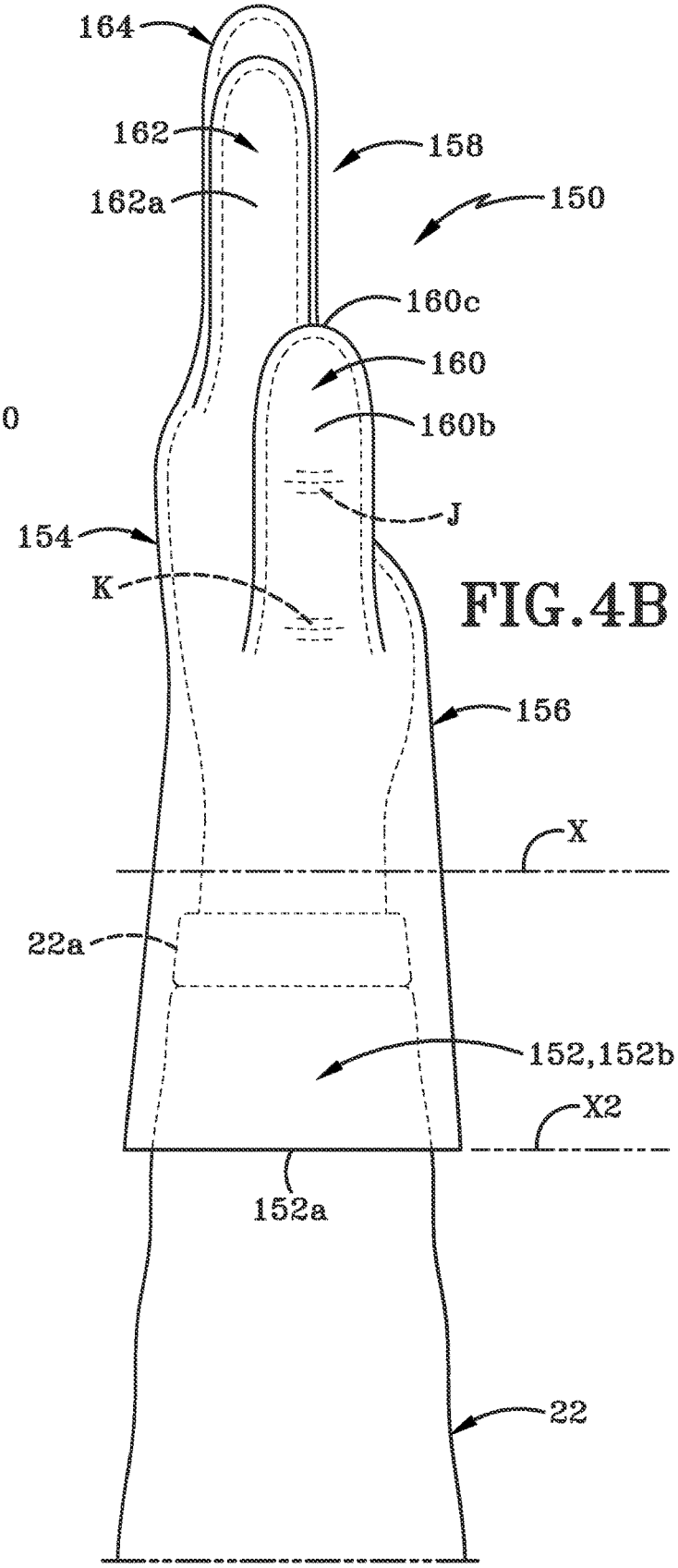
FIG. 4B is a left side elevation view of the glove of FIGS. 3A and 4A, showing the person's hand in phantom within the glove interior.

Glove 150 is an ambidextrous glove that is illustrated in FIG. 4A. In an ambidextrous glove, such as glove 150, the thumb region 160 and finger regions 158 are all aligned along a common imaginary plane, shown in FIG. 4A as imaginary plane "A". As mentioned earlier herein in reference to the PRIOR ART glove 10, in hand-specific gloves the finger regions will all be aligned along a common imaginary plane but the thumb region will not be in that same imaginary plane but will instead be located in a different imaginary plane that is forwardly of the palm region of the glove.

Referring particularly to FIG. 3A, three imaginary planes "X", "X1", and "X2" are marked on the illustrated glove 150. The three imaginary planes "X", "X1", and "X2" are horizontally-oriented (with respect to the manner in which the glove 150 is illustrated in FIG. 3A) and are arranged parallel to one another. The imaginary planes "X", "X1", and "X2" are all oriented at right angles to the common imaginary plane "A" (FIG. 4A). The narrowest width "W" of wrist region 152 of glove 150 extends along imaginary plane "X". Imaginary plane "X" will be positioned slightly below a bottom of the person's hand "LH" when glove 150 is worn. Imaginary plane "X1" runs through the lowest region of the thumb crotch 170*a*. Imaginary plane "X2" runs along the bottom edge 152*a* of the wrist region 152. The region of the glove 150 located between the imaginary plane "X" and the imaginary plane "X2" comprises substantially all of the wrist region 152 of glove 150.

Still referring to FIG. 3A, two additional imaginary planes "Y" and "CP" are marked on the illustrated glove 150. Imaginary planes "Y" and "CP" are oriented generally parallel to one another and at right angles to imaginary planes "X", "X1" and "X2". Imaginary plane "Y" extends generally along the first side 162*a* of index finger 162 passing through thumb crotch 170*a*. Imaginary plane "CP" is a central plane that indicates a center of the width "W".

Still referring to FIG. 3A, imaginary plane "Y" intersects with imaginary plane "X" at an intersection indicated by reference character "I". Imaginary plane "Y" also intersects with the region of the glove 150 extending downwardly from second side 160*b* of thumb region 160 towards wrist region 152 in the direction indicated by arrow "B". The region where imaginary plane "X" intersects with first side 152*b* of wrist region 152 of glove 150 is identified as the transition region "T". As is evident from FIG. 3A, the transition region "T" is located outwardly away from the intersection region "I" in a direction moving away from the center plane "CP", and more particularly moving away from an exterior surface of first side 152*b* of wrist region 152. In other words, the transition region "T" is not located within the zone extending between imaginary planes "Y" and "CP". This is in stark contrast to the PRIOR ART glove 10 wherein the transition region "T" is located inwardly from the intersection region "I" in a direction moving towards the center plane "CP" and in the zone between the imaginary planes "Y" and "CP". Additionally, it is evident from FIG. 3A that the transition region "T" is located on an opposite side of imaginary plane "Y" from the imaginary plane "CP". Additionally, the transition region "T" is located vertically below the lowest part 170*a* of thumb crotch 170. This is in stark contrast to the PRIOR ART glove 10 shown in FIG. 1. FIG. 1 show the transition region "T" is located between the imaginary plane "Y" and the imaginary plane "CP". Additionally, in the PRIOR ART glove 10, the transition region "T" is not located vertically beneath the lowest part 17*a* of the thumb crotch 17 but is instead located laterally inwardly towards the imaginary center plane "CP" and away from the lowest part 17*a* of thumb crotch 17.

The relative distance between the narrowest width "W" extending along imaginary plane "X" and bottom end 152*a* of wrist region 152 extending along imaginary plane "X2", i.e., the length of the wrist region 152 of glove 150 is indicated as the length "L1". Length "L1" for glove 150 that is used in the meat packing industry may be of from about 79 mm up to about 97 mm in length (based on glove Size 6 through Size 10). The imaginary plane "X1" is located a length "L2" away from the imaginary plane "X". The length "L2" is from about 80 mm up to about 94 mm based on a glove 150 Size 6 through Size 10. This will be discussed further later herein.

As shown in FIG. 3A, the narrowest width "W" of the wrist region 152 of glove 150 may be measured when the glove is laid flat on a flat surface. The measured width "W" will be equal to approximately half of the circumference of wrist region 152 along imaginary plane "X". The distance between the imaginary center plane "CP" and the first side 152*b* of the wrist region 152 taken along imaginary plane "X" is indicated as "D1" and the distance between imaginary center plane "CP" and the second side 152*c* of wrist region 152 is indicated as "D2". Center plane "CP" is equidistantly located between the first side 152*b* and second side 152*c* of wrist region 152. In other words, "D1" plus "D2" equals the narrowest width "W" of glove 150. Gloves 10 have a narrowest width "W" in the range of from about 98.5 mm up to about 130 mm. "D1" and "D2" are substantially equal in size. "D1" and therefore "D2" is therefore in the range of from about 49 mm up to about 65 mm. The width of bottom end 152*a* of wrist region 152 on glove 10 is in the range of from about 127 mm up to about 150 mm. Wrist region 152 therefore tapers from bottom end 152*a* towards width "W".

Glove 150 is contemplated to be fabricated from any material suitable for use in meat packaging or meat processing applications, or in chemical processing applications. Suitable materials may include latex, nitrile, and natural rubber. Glove 150 may be a safety glove that is fabricated from or includes protective, strengthening and/or safety materials such as poly-para-phenylene terephthalamide (sold under the trademark KEVLAR®. KEVLAR® is a registered trademark of E. I. DU PONT DE NEMOURS AND COMPANY of Wilmington, Del., US), or metals such as steel that improve the cut-resistance of the glove, and/or materials that allow the glove 150 to be heat resistant, cold resistant, and/or water resistant.

Glove 150 is further contemplated to be fabricated to have a thickness in the range of from about 5 mils up to about 15 mils, where the thickness is measured from an exterior surface of glove 150 through to an interior surface that bounds and defines the interior cavity 150*a*. In one embodiment, the finger regions 158 is of a thickness of from about 5 mils up to about 15 mils, and preferably is about 8 mils; the back region 154 and palm region 156 are of a thickness from about 5 mils up to about 15 mils, and preferably are about 7 mils; and the wrist region 152 is of a thickness of from about 4 mils up to about 15 mils, and preferably is about 5 mils thick. At these thicknesses glove 150 is typically able to be used more than once, i.e., it may be used as a reusable glove instead of a single use glove. A multiple-use glove is able to be put on, pulled off, and then put on again at a later time. A single use glove, on the other hand, is able to be put on but after being pulled off it has to be discarded. It will be understood that, if the person desires, the glove 150 may be discarded after a single use. In one embodiment, glove 150 may be fabricated to be less than the thickness ranges described above and, in these instances, glove 150 likely may only be used once.

It will be understood that glove 150 when selected for use by any particular person will be selected in an appropriate size for that person's hand, as has been described earlier herein. FIGS. 3A to 4 indicate approximately where a person's thumb joint "J" will be located in thumb region 160 when the appropriately-sized glove 150 is worn on the person's left hand. FIGS. 3A to 4 are also marked up to generally indicate where the person's knuckle "K" will be located at the base of the person's thumb when the appropriately-sized glove 150 is worn.

Figure 5A:
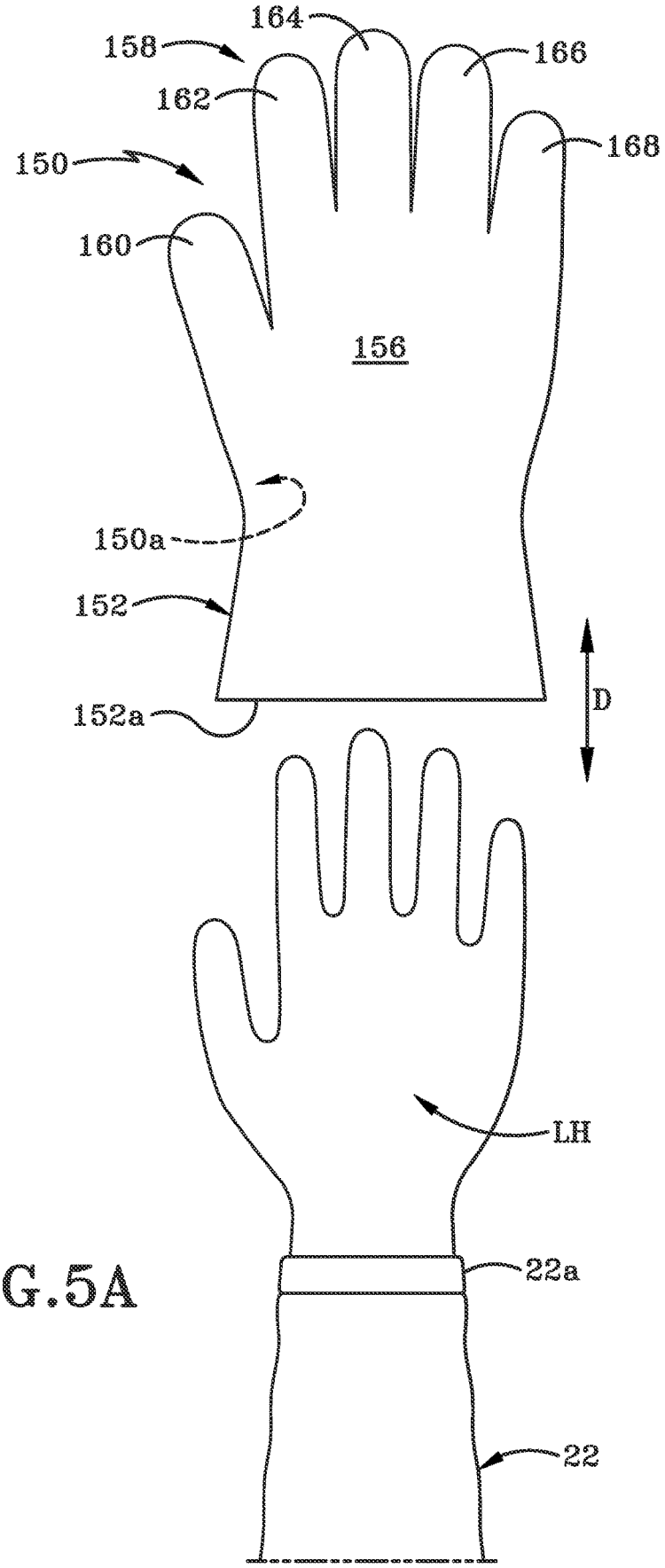
FIG. 5A is an exploded front elevation view showing the glove of FIG. 3A being positioned to be pulled onto a person's hand, where the person is wearing a long sleeved shirt.

Referring now to FIG. 5A, glove 150 is shown positioned to be pulled onto a person's left hand "LH" or positioned immediately after removing glove 150 from the person's left hand "LH". As mentioned earlier herein, it should be understood that the glove 150 is appropriately-sized or correctly-sized to be received on the person's hand "LH".

A portion of the person's forearm and their left hand "LH" is illustrated in FIG. 5A. The person's wrist and forearm are shown covered by a long sleeve 22 of a shirt or sweater. The long sleeve 22 terminates at a cuff 22*a* that is located on the person's wrist a short distance away from the bottom of the person's hand, i.e., a short distance below imaginary plane "X". The person's hand "LH" is inserted through the opening (not shown) circumscribed and defined by bottom edge 152*a* of glove 150 and is received into the interior cavity 150*a* (FIG. 3A) of glove 150. FIG. 3A shows the person's hand "LH" located within the interior cavity 150*a*. The width of the person's wrist is indicated by the reference character "W1". Because the width "W" (and thereby the circumference) of the wrist region 152 of the glove 150 is quite a bit larger than the width "W1" (and thereby the circumference) of the person's wrist, glove 150 is readily able to be pulled onto the person's hand "LH". When the person's hand is fully received within cavity 150*a*, a gap is created between the narrowest portion of the person's wrist at "W1" and the narrowest width "W" of glove 150. It can be seen in FIG. 3A that a gap is defined between the entire exterior surface of the person's hand and wrist and the interior surface of the glove 150. This gap is larger around the person's wrist. By contrast, FIG. 1 shows that little to no gap exists between the exterior surface of the person's hand and wrist and the interior surface of the PRIOR ART glove 10 that defines the cavity 10*a*. In other words, particularly the wrist region 12 of the PRIOR ART glove 10 closely conforms to the person's wrist while the wrist region 152 of the glove 150 does not closely conform to the person's wrist but is instead spaced a distance outwardly away therefrom. It is acknowledged that different people will have differently shaped and sized hands, wrists, and forearms. If, a person has a larger circumference wrist, then they are highly likely to have a larger circumference hand and therefore will select an appropriate larger size glove 150 to wear. Regardless of the size of a person's hand and wrist, if they select an appropriately-sized PRIOR ART glove 10, the wrist region 12 thereof will closely conform to their hand and wrist. If the person selects an appropriately-sized glove 150 in accordance with the present disclosure, the wrist region 152 thereof will not closely conform to their hand and wrist but be spaced a distance away therefrom. This additional space makes glove 150 much easier to pull on and take off than PRIOR ART glove 10.

The movement of the glove 150 in a direction onto the person's hand "LH" or off of the person's hand "LH" is indicated by the arrows "D" in FIGS. 3A, 4 and 5A In accordance with one aspect of the present disclosure, the wrist region 152 of glove 150 is able to be easily pulled over an exterior surface of the end portion of the long sleeve 22 that circumscribes the person's wrist and forearm. As a consequence, the person will not have to pull their sleeve 22 upwardly along their arm and away from their hand in order to pull the glove 150 on or off. The sleeve cuff 22*a* and lower portion of the sleeve 22 are readily and securely covered by the wrist region 152 of the glove 150. The bottom edge 152*a* of the wrist region 152 lays over the exterior surface of the sleeve 22 when the glove 150 is worn. This can be seen in FIG. 3A. No part of the person's skin is exposed or unprotected while putting glove 150 on, while wearing glove 150, or while taking glove 150 off. The wrist region 152 overlaps the sleeve 22 and covers the person's wrist. Because the sleeve cuff 22*a* and the lower portion of the sleeve 22 are covered by wrist region 152, there is no risk of the sleeve cuff 22*a* or end region of the sleeve 22 coming into contact with the product with which the person is working. So, for example, if the person is a meat packer and is processing meat, the sleeve cuff 22*a* and end region of the sleeve 22 will be protected from becoming soaked with blood or other bodily fluid by the wrist region 152 of glove 150. The wrist region 152 also prevents the sleeve 22 and the person's skin from coming into contact with the meat and contaminating the same. If the person is handling chemicals of some type, those chemicals are effectively prevented from transferring onto the sleeve cuff 22*a* of the sleeve 22 or contacting the person's skin by the glove material, particularly the material of the wrist region 152. The sleeve 22 is thereby effectively prevented from becoming contaminated by the product the person is handling. Additionally, substances on the sleeve 22 are not able to be transferred to the product the person is working with because the exterior surface of the lower portion of the sleeve 22 is covered by the wrist region 152 of the glove. Therefore substances on the sleeve 22 will not contaminate the product.

When the person wishes to remove glove 150, the person will simply use the opposite hand and grasp the digit region 158 and pull the glove 150 off their hand in a direction moving away from the person's fingers. The index finger region 162, middle finger region 164, ring finger region 166, and little finger region 168 may be grasped individually or more than one of these finger regions 162-168 may be grasped at the same time. Alternatively, but less desirably, the person may also easily grasp the lowermost end 152 of the wrist region 150, which overlaps sleeve 22, and pull the glove 150 off their hand. In either method of removing glove 150, there is no need to pull any part of the sleeve 22 out of the way in order to be able to grasp the bottom edge 152*a* of wrist region 152. There is therefore no possibility of any substance on the digit regions 158 or thumb region 160 of directly contacting the person's skin when the glove is removed.

Furthermore, because the wrist region 152 is of a width "W1" that is quite a bit larger than the width of the person's wrist, glove 150 is able to be easily pulled off the person's hand without inverting the glove 150, i.e., turning the glove 150 inside out. Consequently, it is possible for the glove 150 to be reused at a later time as the person can simply pull the glove 150 back on over their hand "LH" by grasping a lower portion of the wrist region 152 and inserting their fingers into the opening bounded and defined by the bottom edge 152 of the wrist region 152 and into the interior 150*a* of the glove 150 as described earlier herein. It is therefore possible to be able to use glove 150 more than once. In other words, glove 150 is contemplated to be a multiple use glove because it can be pulled on, pulled off, and pulled on again. The glove 150 doesn't invert if the finger region 158 is used to remove glove 150 from the hand and therefore glove 150 typically does not need to be turned right side out before putting the glove back on. Alternatively, if so desired, glove 150 may be used as a single use glove that is discarded after a single use.

While glove 150 is contemplated to be a multi-use glove i.e., reusable glove that is used more than once by a worker in a single shift instead of being discarded after a first use, it will be understood that in some applications, it may be desirable or necessary to discard glove 150 after a single use. Even if the glove 150 is used as a single use glove, glove 150 provides the advantages of being able to be pulled on and off easily and to cover a portion of a long sleeve on a shirt or lab coat worn by a user.

Figure 5B:
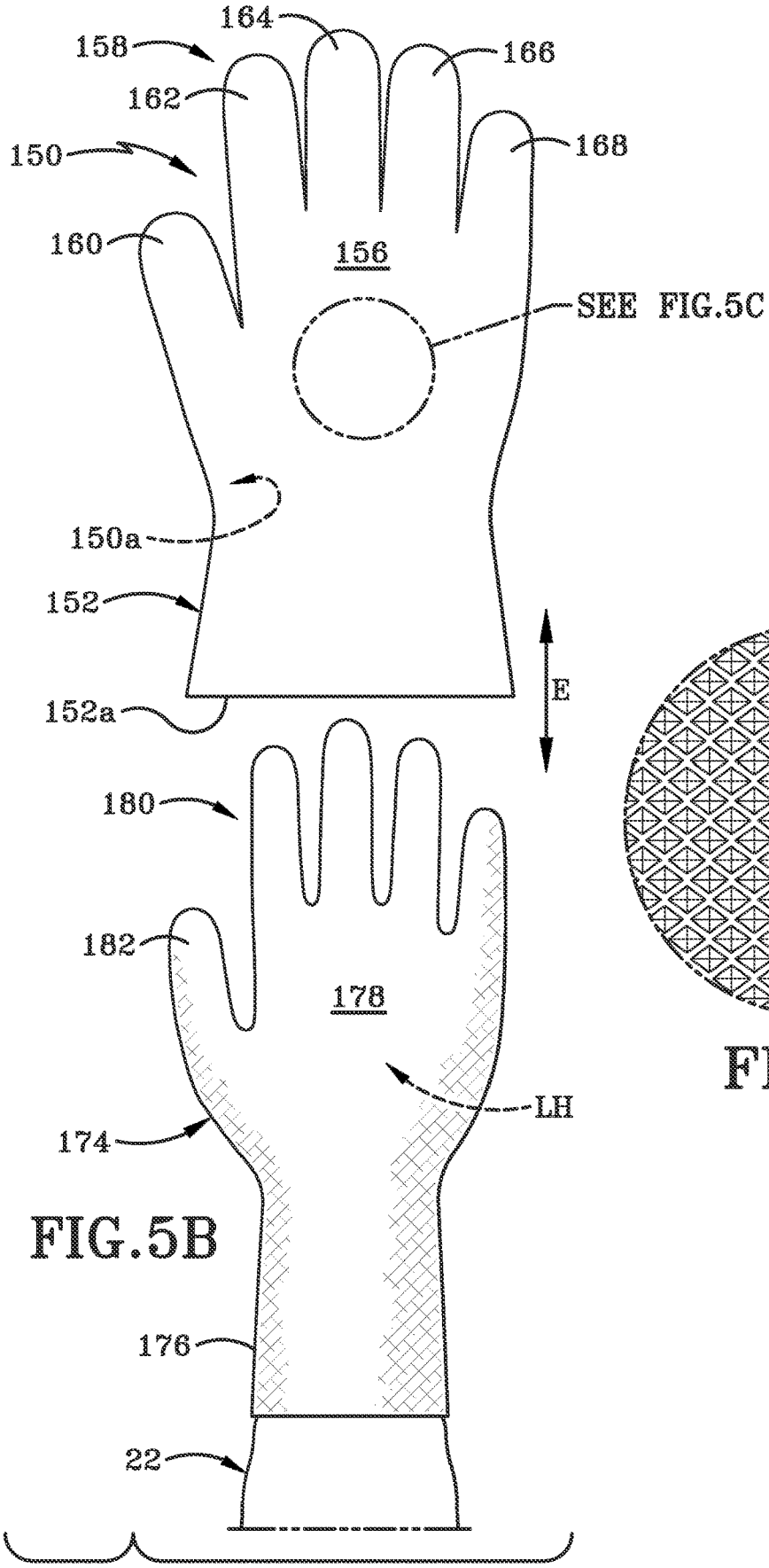
FIG. 5B is an exploded front elevation view showing the glove of FIG. 3A being positioned to be pulled onto a person's hand, where the person is wearing a liner and a long sleeved shirt.

Glove 150 is also contemplated for use in applications where double-gloving is desirable. What is meant by the term "double gloving" is that glove 150 is contemplated to be donned over another glove, where the other glove is in direct contact with the person's hand "LH" and the glove 150 is in direct contact with an exterior surface of the other glove. FIG. 5B shows an example of the glove 150 being used in a double-gloving application. The figure shows a person's hand and wrist region which has been already covered by a liner 174. Liner 174 is contemplated to be a protective glove that is useful for protecting the person's hand against one or more hazards. Liner 174 may be fabricated from a material that provides comfort to the person's hand in that it is soft to the touch and/or protects the person's hand from one or more of cold, heat, chemicals, moisture, abrasions, and cuts. The protective glove or liner 174 may be of any of a number of different types that may be desired for use in any particular application and may be fabricated from any suitable materials with desired properties to protect the person's hand from hazards or to provide comfort to the person's hand. For example, liner 174 may be fabricated from an insulating material that keeps the hand warm in cold environments, such as in meat packing plants. In other instances, liner 174 may be fabricated from an insulating material that prevents high heat from affecting the person's hand. In other instances, liner 174 may be fabricated from a moisture-wicking material or a soft material such as cotton that is comfortable and soft to the touch. These materials may help absorb moisture on the person's hand (from perspiration, for example) and provides a soft and comfortable fitting around the person's hand. The soft, comfortable fit may particularly be desirable if the material used for glove 150 includes metals that might make the glove 150 uncomfortable to wear. In other examples, the liner may be fabricated from a cut-resistant material that protects the person's fingers, thumb, palm, and back of their hand from being easily cut by a knife or blade, or sharp materials the person is handling. Whatever material is used to fabricate liner 174, the liner 174 is pulled over the person's hand and wrist, and typically closely conforms thereto.

It should be noted that the glove 150 is differently configured to the liner 174 and the glove 150 does not closely conform to the person's hand or to the liner 174 because glove 150 is of a different shape to the liner 174. Liner 174 may more closely resemble the PRIOR ART glove 10 than the glove 150. In particular, the glove 150 has a wrist region 152, back region 154, and palm region 156 that do not closely conform to a lower region of the person's hand "LH" proximate imaginary plane "X".

A shown in FIG. 5B, liner 174 includes a wrist region 176, a palm region (not shown), a back region 178 (which covers a back of the person's hand), finger regions 180 which cover the person's index finger, middle finger, ring finger, and little finger, and a thumb region 182. Liner 174 is shown as being pulled over the person's hand and wrist. (FIG. 5B shows glove 150 being pulled onto or off of liner 174 in the directions indicated by arrow "E"). Liner 174 is shown as being pulled over a long sleeve 22 of a shirt or sweater worn by the user. The sleeve cuff 22*a* (not shown in this figure) is located under the wrist region 176 of the liner 174. In other instances, depending on the type and thickness of liner 174, the person may select to pull the sleeve 22 of their shirt or seater over an exterior surface of the wrist region 176 of the liner 174.

Glove 150 is contemplated to be a barrier glove that is donned over the exterior surface of the protective glove or liner 174 such that the person's hand is effectively "double-gloved", i.e., two gloves on one hand. The barrier glove 150 may be fabricated from a material that provides additional protective features to the person's hand "LH". For example, glove 150 may be fabricated from a material that provides moisture resistance. In other instances, the barrier glove 150 may be fabricated from materials that also provide a protective feature to the person's hand, such as cut resistance.

FIG. 5B further shows the glove 150 in accordance with the present disclosure being readied to be pulled over an exterior surface of liner 174 after the liner 174 has previously been pulled onto the person's hand, or shows the glove 150 after removal from over the person's hand that is covered by liner 174. The widened wrist region 152 of glove 150 makes it possible for the glove 150 to be pulled over the exterior surface of the liner 174 and/or lower part of the worker's shirt or sweater sleeve 22 which may not be covered by liner 174. The widened wrist region 152 helps to ensure that there is reduced friction between the interior of glove 150 and the exterior of the liner 174. As the glove 150 is pulled on over liner 174 it will not tend to cause liner 174 to be pulled uncomfortably tightly over the fingers and thumb of the user. It is additionally relatively easy to pull glove 150 off from over liner 174 without additionally pulling liner 174 off the person's hand and without turning glove 150 inside out. Glove 150 may consequently be pulled back on over liner 174 at a later time and be reused as discussed hereafter.

Glove 150 may therefore be used in combination with liner 174, where the liner is configured to be closely conformed to a person's hand. At least wrist region 152 of the glove 150 does not conform closely to the user' hand and this makes it easier for glove 150 to be pulled on and off. In particular, glove 150 is relatively easily removed from the person's hand or from over liner 174 by the person simply grasping the fingertips of the glove 150 with their other hand and pulling the glove 150 off the hand as previously described herein. Glove 150 will then slide off the liner 174. The liner 174 may be left on the person's hand or may be separately removed therefrom.

Glove 150 is therefore contemplated to be able to be pulled onto the person's hand "LH" over the liner 174 in a substantially similar fashion to how glove 150 is pulled directly over the person's hand as shown in FIG. 5A and discussed earlier herein. Glove 150 may be removed from over liner 174 sometime later. The liner 174 may then be removed from the person's hand "LH" or may be left in place. Still later, the glove 150 may once again be pulled over the liner 174 and thereby over the person's hand. This procedure may be repeated multiple times. In other words, glove 150 is reusable one or more times, particularly one or more times during a work shift. At the end of the work shift the glove 150 is removed from over the liner 174, and the liner 174 is removed from over the person's hand "LH". Glove 150 may then be discarded after these multiple uses. In some instances, the glove 150 may be reused the next time the person has a work shift. In yet other instances, the glove 150 may be discarded after a single use.

One of the reasons glove 150 may readily be pulled on an off is the provision of a widened wrist region 152 on the glove 150 and where exactly this widened region begins relative to the lowest region 170*a* of thumb crotch 170. FIGS. 7A, 8A, 9A, 10A, 11A, and 12A each show a former 310, 410, 510, 610, 710, and 810. The formers are 3-Dimensional components which are utilized in the fabrication of glove 150, with each former being shaped, and sized slightly differently so that the gloves 150 fabricated therewith are differently sized and slightly differently shaped. The use of formers in the fabrication of gloves is well known and therefore a method of utilizing formers 310 through 810 will not be discussed in any detail herein. FIGS. 7B, 8B, 9B, 10B, 11B, and 12B each show an enlargement of one end of the associated former and are marked to show the imaginary planes "X" and "Y", and the locations of the intersection region "I" and transition region "T" for the glove that will be fabricated using that particular former. The imaginary planes "X", "Y", intersection region "I", and transition region "T" shown on FIGS. 7B through 12B were discussed earlier herein with respect to FIG. 3A. As is evident from FIGS. 7A through 12B, the widening of the wrist region 152 on glove 170 begins before the imaginary plane "Y" extending along the first side 162*a* of the index finger region moving in a direction "B" down the second side 160*b* of thumb region 160 and towards the imaginary plane "Y".

Glove 150 may be used for example, in a meat packing plant in the following manner. The person will pull a glove 150 over each hand or over a cut-resistant or thermally-insulating liner 174 that has been previously pulled onto each hand. The person will then perform their work functions while wearing gloves 150 and liners 174. Sometime later, perhaps at a lunch break, the person will remove gloves 150 from over associated liners 174 and will set them aside. Because of the configuration of glove 150, the gloves 150 may be pulled off of the person's hands from over the associated liners 174 without inverting the gloves 150. The liners 174 may also be removed from the person's hands for this lunch break. In other instances, the person may continue to wear the liners 174. After some period of time, e.g. an hour or more, the person will return to their work station, pull the liners 174 back onto their hands if they were previously removed therefrom. The worker will then pull on the same gloves 150 they were using prior to their lunch break, and will then continue their work. Gloves 150 may be pulled on, pulled off, pulled back on, and pulled back off again a number of times during a single work shift as desired or needed. In other words gloves 150 may be reused one or more times as desired. The worker may change the liners 174 as needed by removing gloves 150 and then placing them over the new liners. In other instances, gloves 150 may be reused once and then be discarded. In yet other instances, gloves 150 may be used a single time and then be discarded. Over a period of time, such as a length of the worker's shift, for example a shift lasting eight hours more or less, gloves 150 may be pulled on, be used to perform a task, may be removed while the worker takes a break, may be pulled back on, used to perform a task, pulled over for a second break, pulled back on etc. Over the length of this period of time, the gloves may be pulled on and off several times with relative ease and without tending to tear or become damaged.

It will be understood that in other embodiments, the liner 174 may be omitted and the material used to fabricate glove 150 may itself include an integral layer or a material that offers the same advantages as liner 174. For example, instead of providing an insulating liner 174, glove 150 may be fabricated from an insulating material. In one embodiment, the insulating material may protect the person's hand from cold. In one embodiment, the insulating material may protect the person's hand from heat. The interior surface of glove 150 may include flocking that makes glove 150 more comfortable on the hand when the glove 150 is in direct contact with the skin as in FIG. 5A.

Figure 5C:
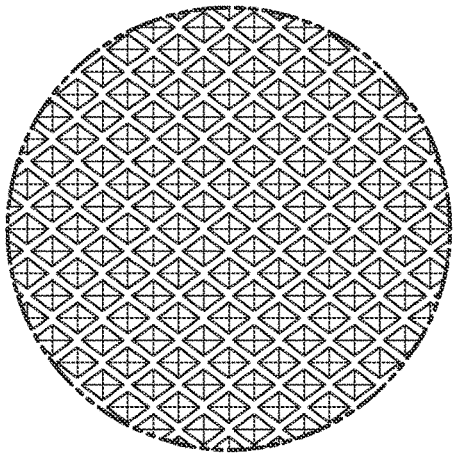
FIG. 5C is an enlarged front elevation view of the highlighted region of FIG. 5B, showing an exemplary surface pattern that may be provided on various gripping surfaces on the front and back of the glove or even all over the glove's exterior surface.

At least a portion of the body of glove 150 may be textured, i.e., provided with a pattern or texturing on or in the exterior surface of the glove, particularly on the regions of glove 150 that are used for gripping. So, for example, a pattern or texture as illustrated in FIG. 5C may be provided on some or all of back region 154, palm region 156, and portions of the front and back surfaces of the finger regions 158 and thumb region 160, i.e., the regions of the glove 150 used for gripping objects. The wrist region 152 may not be provided with texturing since the wrist region 152 is not used for gripping objects. In other instances, the entire glove 150 may include patterning or texturing. The pattern or texture may be applied over the exterior surface of the glove 150 or may be formed integrally in the glove material when the glove 150 is fabricated. The pattern or texture selected may be the diamond pattern or texture shown in FIG. 5C, for example. In other embodiments, the pattern or texture may resemble sand, or fish scales, or zig-zags, or herringbone, or any other known pattern or texture used on currently known gloves.

Figure 6:
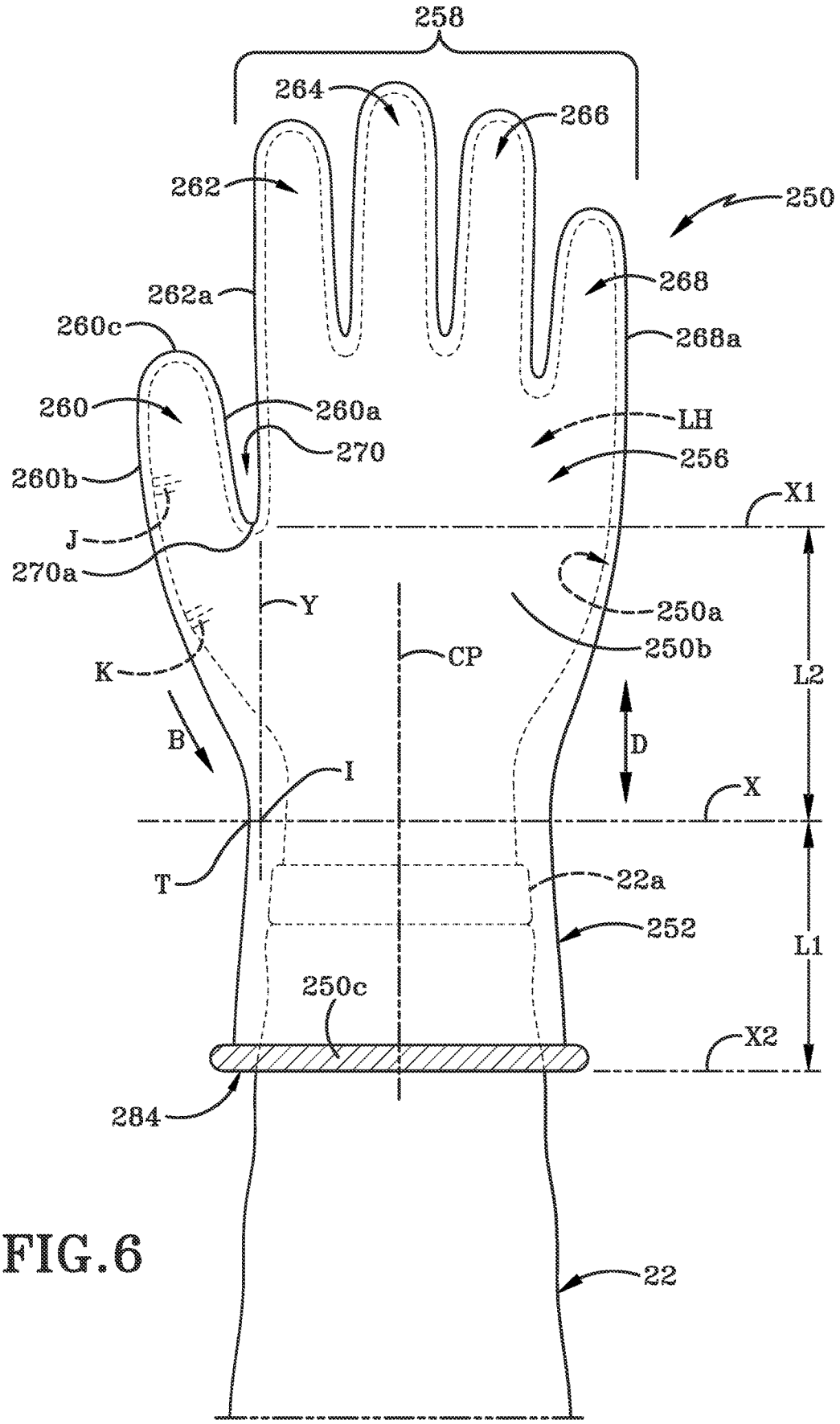
FIG. 6 is a front elevation view of a second embodiment of a glove in accordance with an aspect of the present disclosure showing a rolled cuff on a bottom edge of the glove and showing a person's hand in phantom within the glove interior, where the person is wearing a long sleeved shirt.

Referring now to FIG. 6, there is shown a second embodiment of a glove in accordance with the present disclosure, generally indicated at 250. FIG. 6 shows a person's hand "LH" in phantom within the glove interior 250*a*. Glove 250 is substantially identical in structure and function to glove 150 except for the differences that will be noted hereafter. Arrow "F" shows how glove 250 may be pulled on or off the person's hand. Glove 250 includes a wrist region 252, a back region (not shown but identical to back region 154), a palm region 256, finger regions 258, and a thumb region 260. The finger region 258 includes an index finger region 262, a middle finger region 264, a ring finger region 266 and a little finger region 268. The finger regions 258 cover the person's index finger, middle finger, ring finger, and little finger when glove 250 is worn on the person's hand "LH". The thumb region 260 covers the person's thumb when the glove 250 is worn. A thumb crotch region 270 is defined between the thumb region 260 and index finger region 262 and the lowermost part of the thumb crotch 270 is identified by the reference character 270*a*.

Glove 250 differs from glove 150 in that an exterior surface 250*b* of glove 250 is of a first color and an interior surface 250*c* of glove 250 is of a second color that is different from the first color. Glove 250 may, for example, be comprised of an outer layer 250*b* of the first color and an inner layer 250*c* of the second color. If a cut or tear occurs in the glove 250, the second color of the interior surface 250*c* or inner layer 250*c* may become visible to the person or to an observer. The visible second color will indicate to the person or to an observer that the glove is damaged and must be discarded.

The particular first color and second color for glove 250 may be selected to be a specific color combination. This color combination may be utilized to identify a part of a plant or a particular process in the plant that the particularly-colored glove is to be used. This is useful, for example, if different processes are being undertaken in different parts of the plant and the gloves used in the different processes have to have specific properties. For example, in meat packing plant, it may be advantageous to have a specific color glove, i.e., specific combination of first color and second color that indicate a particular glove has enhanced cut resistance. Another specific color combination may indicate that a particular glove is resistant to specific chemicals or fluids.

Workers in particular processes or areas or even different factories may utilize specific selected color combinations of glove 250. If a piece of glove breaks off and becomes mixed up with the product being handled, it is possible for that damaged piece of glove to help identify where in the process or plant the glove originated. This color specificity may help a plant manager to monitor whether gloves are being particularly damaged in certain parts of the plant or in certain processes in the plant. Safety training or other measures may then be put in place to reduce this problem.

The use of different colors of gloves in different areas or processes of a plant, or in different plants, with or without specific identifiers thereon so that the origin of a piece of damaged glove can be traced is described in various patents to the present Assignee. A system and method of tracking glove failure is described in U.S. Pat. No. 9,380,794 (Hull); U.S. Pat. No. 9,635,891 (Hull); U.S. Pat. No. 10,028,542 (Hull), and U.S. Pat. No. 10,806,196 (Hull), all assigned to Summit Glove, Inc. These four patents are all incorporated herein by reference in their entirety. It will be understood that this features described in these aforementioned patents for tracking glove failure may be incorporated into glove 150 as well and failure of glove 150 can be tracked in accordance with the disclosures of these patents.

Glove 250 as illustrated in FIG. 6 further differs from glove 150 in that instead of simply having a thin single-layer bottom edge 152*a*, glove 250 is provided with a rolled or beaded glove cuff indicated at 284. Glove cuff 284 may be produced by rolling a length of the wrist region 152 material back on itself during glove fabrication. This rolling or beading of glove cuff 284 makes the differently colored interior surface or inner layer visible to an observer or user. This feature may be useful in order to ensure the correct glove type is being used in a particular process in a plant as described above. The rolled glove cuff 284 itself, whether differently colored or not, makes it easier for the person to grasp the bottom edge of the glove 250 to pull the glove 250 on or to take glove 250 off. Such a rolled cuff 284 may be provided on glove 150. Glove 250 may be provided with a pattern or texture in a similar manner to the pattern or texture provided on glove 150 described earlier herein.

Although not illustrated herein, either of glove 150 or the glove 250 may further include fingertip regions on the finger regions 158, 268 and/or on thumb region 160, 260 that are of reduced diameter or are bullet-tip shaped. These reduced diameter fingertip regions and the bullet tip fingertip regions help to ensure the glove material does not reduce the tactile sensitivity of the person's fingers and thumb. The feature also helps to maintain the gripping ability of the person's index and middle fingers and their thumb, and may be particularly helpful to hold glove 150 or 250 on the person's hand. U.S. Pat. No. 9,968,145 (Hull), U.S. Pat. No. 10,238,159 (Hull), U.S. Pat. No. 10,390,575 (Hull), U.S. Pat. No. 10,602,787 (Hull), U.S. Pat. No. 10,602,788 (Hull), U.S. Pat. No. 10,820,639 (Hull), U.S. Pat. No. 10,820,640 (Hull), U.S. Pat. No. 10,750,802 (Hull), U.S. Pat. No. D890,999 (Hull), U.S. Pat. No. 10,869,512 (Hull) and application Ser. No. 16/432,127 (Hull), Ser. No. 16/787,560 (Hull), Ser. No. 16/787,809 (Hull), and Ser. No. 29/734,655 (Hull), all assigned to the present Assignee, Summit Glove, Inc., describe these features in detail. These patents and patent applications are incorporated herein by reference in their entirety. Any other features that are described in in these aforementioned patents and patent applications may be incorporated into either of gloves 150, 250.

Turning now to FIGS. 7B, 8B, 9B, 10B, 11B, and 12B, a plurality of formers 310, 410, 510, 610, 710, and 810 are illustrated. Formers 310 through 810 are used in the fabrication of gloves 150 or 250 of different sizes. Each of FIGS. 7B through 12B shows various imaginary planes that are provided to identify regions of the formers that will form the portions of the gloves 150, 250 that are shown with the same imaginary planes. FIGS. 7B through 12B show three imaginary planes "X", "X1", and "X2" identified on the associated formers. The three imaginary planes "X", "X1", and "X2" are horizontally-oriented (with respect to the manner in which the formers are illustrated in these figures) and are arranged parallel to one another. The imaginary planes "X", "X1", and "X2" are all oriented at right angles to a common imaginary plane (not shown) along which the portions of the former used to form the finger regions and thumb of gloves 150, 250 are aligned. The various formers have their narrowest width that will form the narrowest width "W" of wrist region 152 of glove 150 extending along imaginary plane "X". Imaginary plane "X1" runs through that part of the former which will form the lowest region of the thumb crotch 170*a* of glove 150, for example. Imaginary plane "X2" runs along that part of the former which will form the bottom edge 152*a* of the wrist region 152 of glove 150.

Still referring to FIGS. 7B through 12B, two additional imaginary planes "Y" and "CP" are shown on the various formers 310 through 810. Imaginary planes "Y" and "CP" are oriented generally parallel to one another and at right angles to imaginary planes "X", "X1" and "X2". Imaginary plane "Y" extends generally along that part of each former which will form the first side 162*a* of index finger 162 of glove 150. The imaginary plane "Y" passes through that part of the former which will form the lowest region 170*a* of thumb crotch 170 on glove 150. Imaginary plane "CP" is a central plane that indicates a center of the part of the former that forms the narrowest width "W" on glove 150.

Still referring to FIGS. 7B through 12B, imaginary plane "Y" intersects with imaginary plane "X" at an intersection on the former indicated by reference character "I". Imaginary plane "Y" also intersects with that part of the former which will be form the part of the wrist region 152 identified as transition region "T" in FIG. 3A. As is evident from all of FIGS. 7B through 12B, the transition region "T" is located outwardly away from the intersection region "I" moving in a direction away from the center plane "CP", and more particularly moving away from an exterior surface of the former which will form the first side 152*b* of wrist region 152. In other words, the transition region "T" is not located with the zone of the former extending between imaginary planes "Y" and "CP".

Figure 7A:
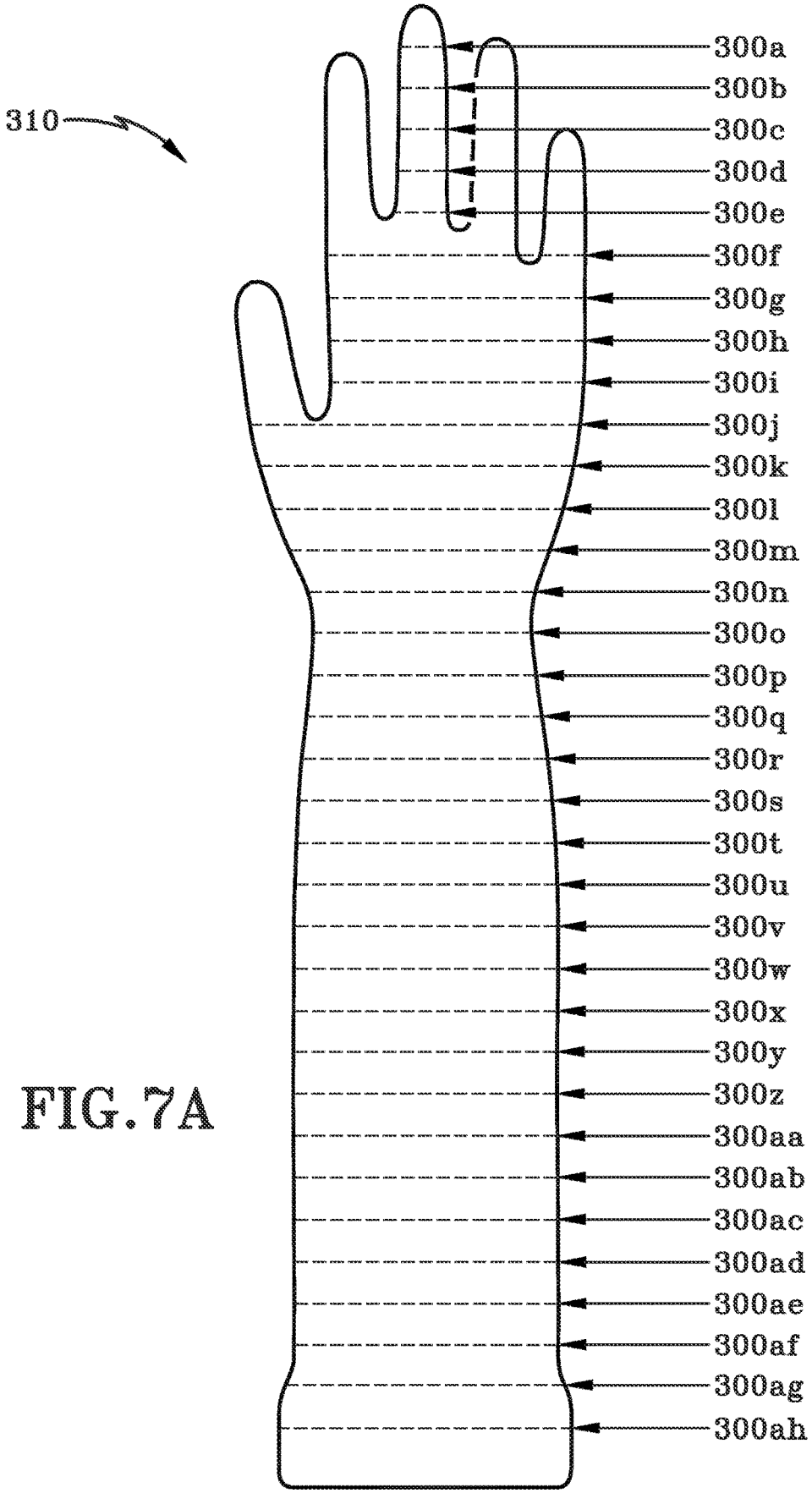
FIG. 7A is a front elevation view of a former for fabricating a Size 6 glove in accordance with an aspect of the present disclosure.
Figure 7B:
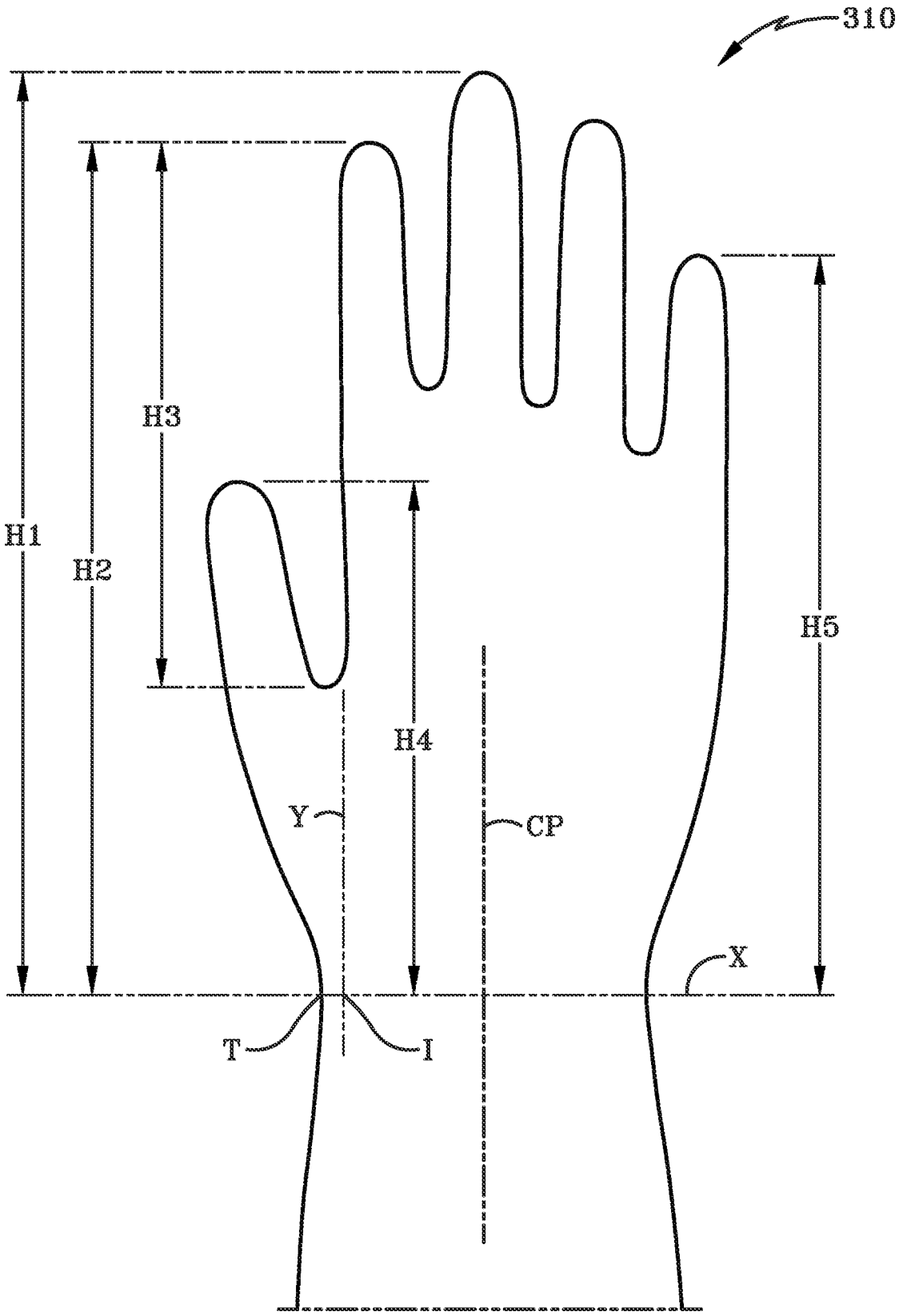
FIG. 7B is a partial enlarged front elevation view of the former of FIG. 7A.

Turning now to FIGS. 7A and 7B, these figures show a former 310 for fabricating a size 6 or X-small glove in accordance with the present disclosure. The circumferences of various regions of the former 310 are identified in FIG. 7A by the reference characters 300*a* through 300*ah*. Measurements were taken of former 310 every half inch from the uppermost tip of a middle finger region of former 310 through to a base of the former located half an inch below the measurement identified at 300*ah*. Table 1, hereafter, identifies the reference characters 300*a* through 300*ah* and the particular circumferences of the portion of the former that was measured. The particular portion of the former 310 that was measured is identified by the dashed lines in FIG. 7A. FIG. 7B shows various length measurements "H1" through "H5" of the upper part of the former 310. The measurements are taken relative to the imaginary plane "X" which is the equivalent of the imaginary plane "X" on FIGS. 3A through 6. The measurements "H1" through "H5" will be discussed later herein.

Figure 8A:
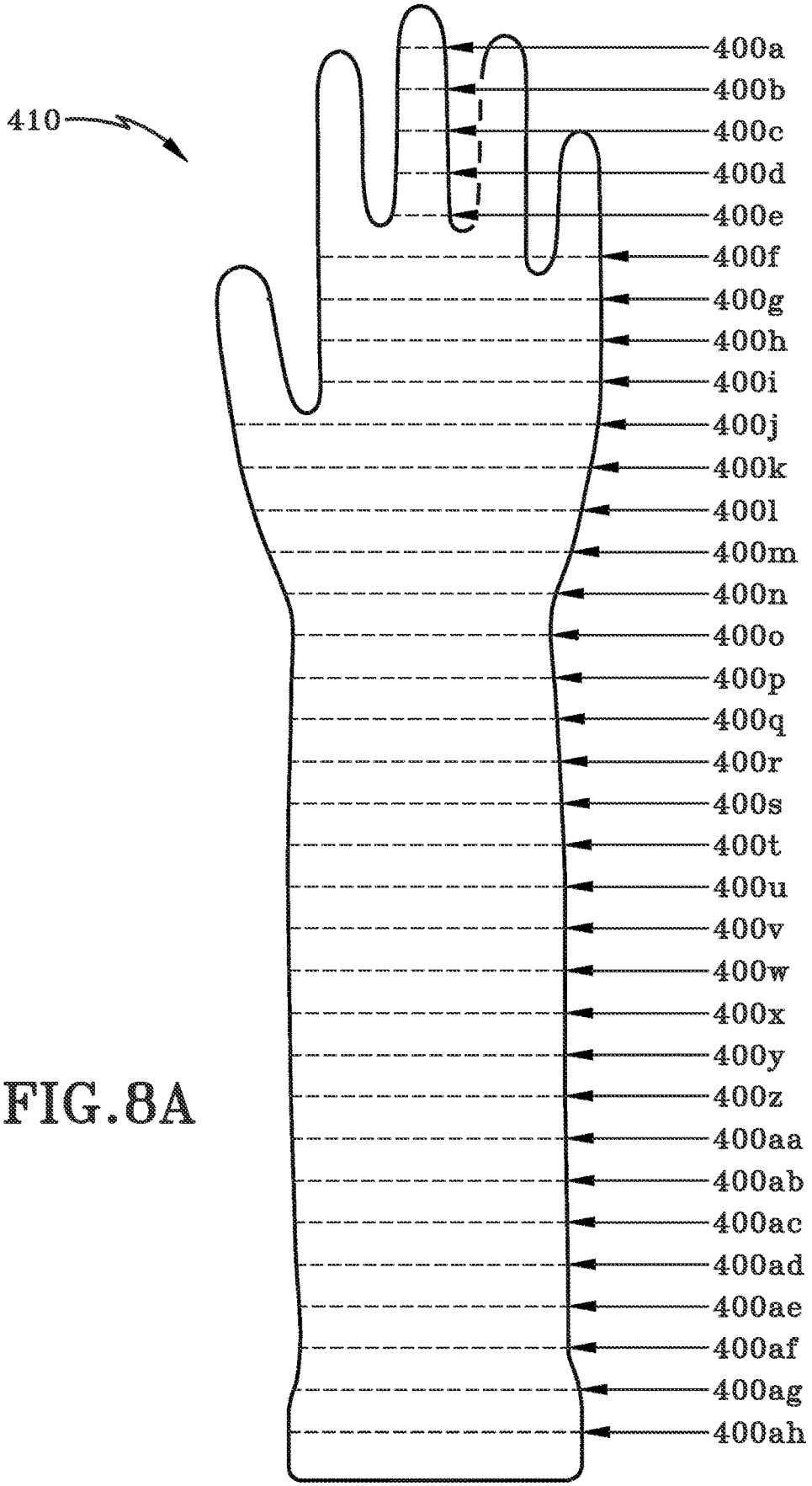
FIG. 8A is a front elevation view of a former for fabricating a Size 7 glove in accordance with an aspect of the present disclosure.
Figure 8B:
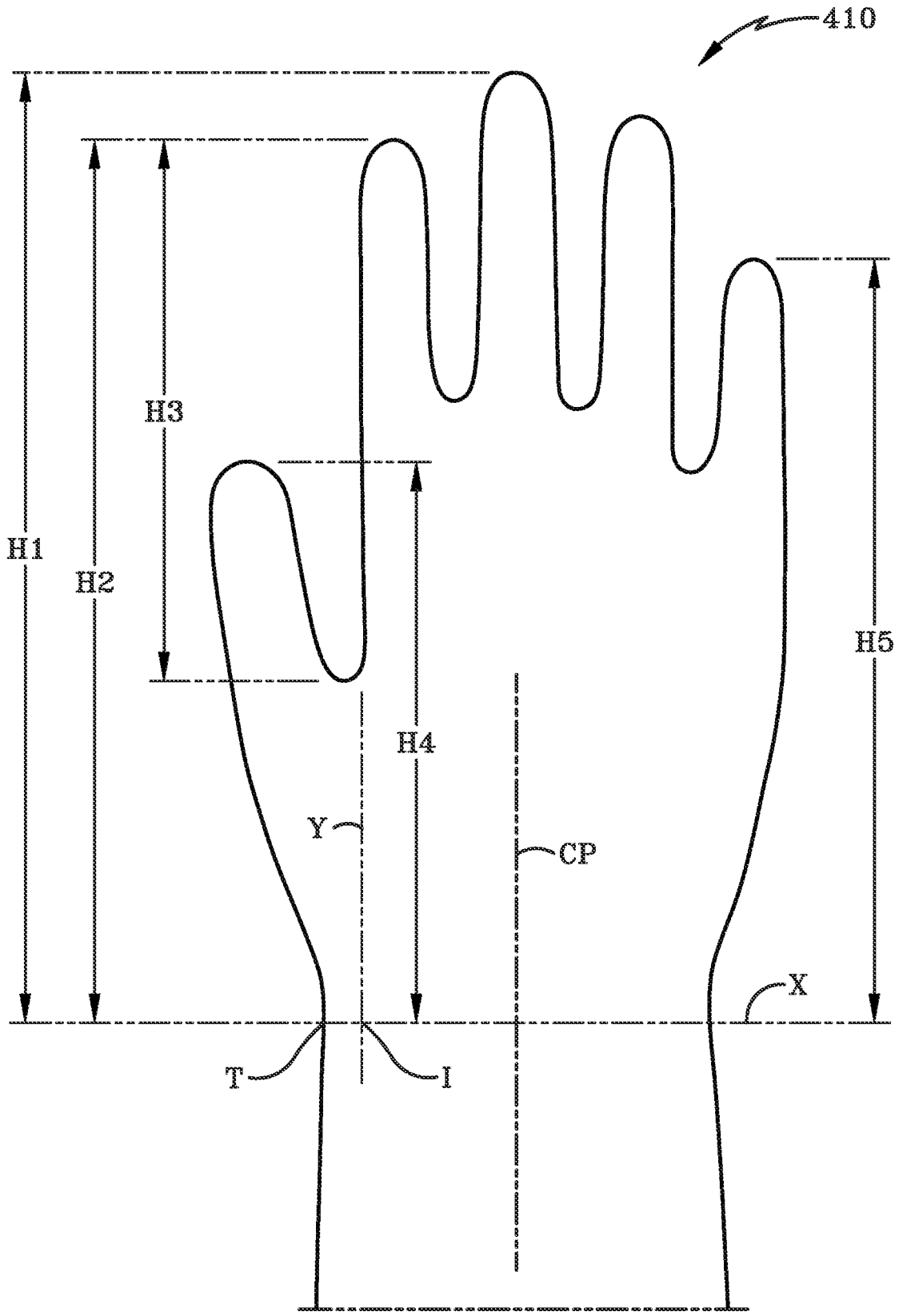
FIG. 8B is a partial enlarged front elevation view of the former of FIG. 8A.

FIGS. 8A and 8B show a former 410 for fabricating a size 7 or Small glove in accordance with the present disclosure. The circumferences of various regions of the former 410 are identified in FIG. 8A by the reference characters 400*a* through 400*ah*. Measurements were taken of former 410 every half inch from the uppermost tip of a middle finger region of former 410 through to a base of the former located half an inch below the measurement identified at 400*ah*. Table 2, hereafter, identifies the reference characters 400*a* through 400*ah* and the particular circumference of the portion of the former that was measured. The particular portion of the former 410 that was measured is identified by the dashed lines in FIG. 8A. FIG. 8B shows various length measurements "H1" through "H5" of the upper part of the former 410. The measurements are taken relative to the imaginary plane "X" which is the equivalent of the imaginary plane "X" on FIGS. 3A through 6. The measurements "H1" through "H5" will be discussed later herein.

TABLE 1

Size 6 (X-small) Glove Former shown in FIGS. 7A and 7B

| Reference Character | Measurements in mm |
|---|---|
| 300a | 65 |
| 300b | 71 |
| 300c | 74 |
| 300d | 77 |
| 300e | 80 |
| 300f | 201 |
| 300g | 204 |
| 300h | 209 |
| 300i | 214 |
| 300j | 252 |
| 300k | 236 |
| 300l | 234 |
| 300m | 214 |
| 300n | 202 |
| 300o | 197 |
| 300p | 205 |
| 300q | 224 |
| 300r | 230 |
| 300s | 242 |
| 300t | 248 |
| 300u | 253 |
| 300v | 254 |
| 300w | 254 |
| 300x | 254 |
| 300y | 254 |
| 300z | 253 |
| 300aa | 253 |
| 300ab | 253 |
| 300ac | 254 |
| 300ad | 254 |
| 300ae | 256 |
| 300af | 256 |
| 300ag | 257 |
| 300ah | 287 |

TABLE 2

Size 7 (Small) Glove Former shown in FIGS. 8A and 8B

| Reference Character | Measurement in mm |
|---|---|
| 400a | 65 |
| 400b | 72 |
| 400c | 75 |
| 400d | 77 |
| 400e | 83 |
| 400f | 219 |
| 400g | 224 |

TABLE 2-continued

Size 7 (Small) Glove Former shown in FIGS. 8A and 8B

| Reference Character | Measurement in mm |
|---|---|
| 400h | 229 |
| 400i | 234 |
| 400j | 278 |
| 400k | 270 |
| 400l | 261 |
| 400m | 255 |
| 400n | 235 |
| 400o | 220 |
| 400p | 227 |
| 400g | 233 |
| 400r | 243 |
| 400s | 252 |
| 400t | 261 |
| 400u | 267 |
| 400v | 267 |
| 400w | 267 |
| 400x | 267 |
| 400y | 267 |
| 400z | 267 |
| 400aa | 267 |
| 400ab | 266 |
| 400ac | 266 |
| 400ad | 265 |
| 400ae | 265 |
| 400af | 264 |
| 400ag | 272 |
| 400ah | 286 |

Figure 9A:
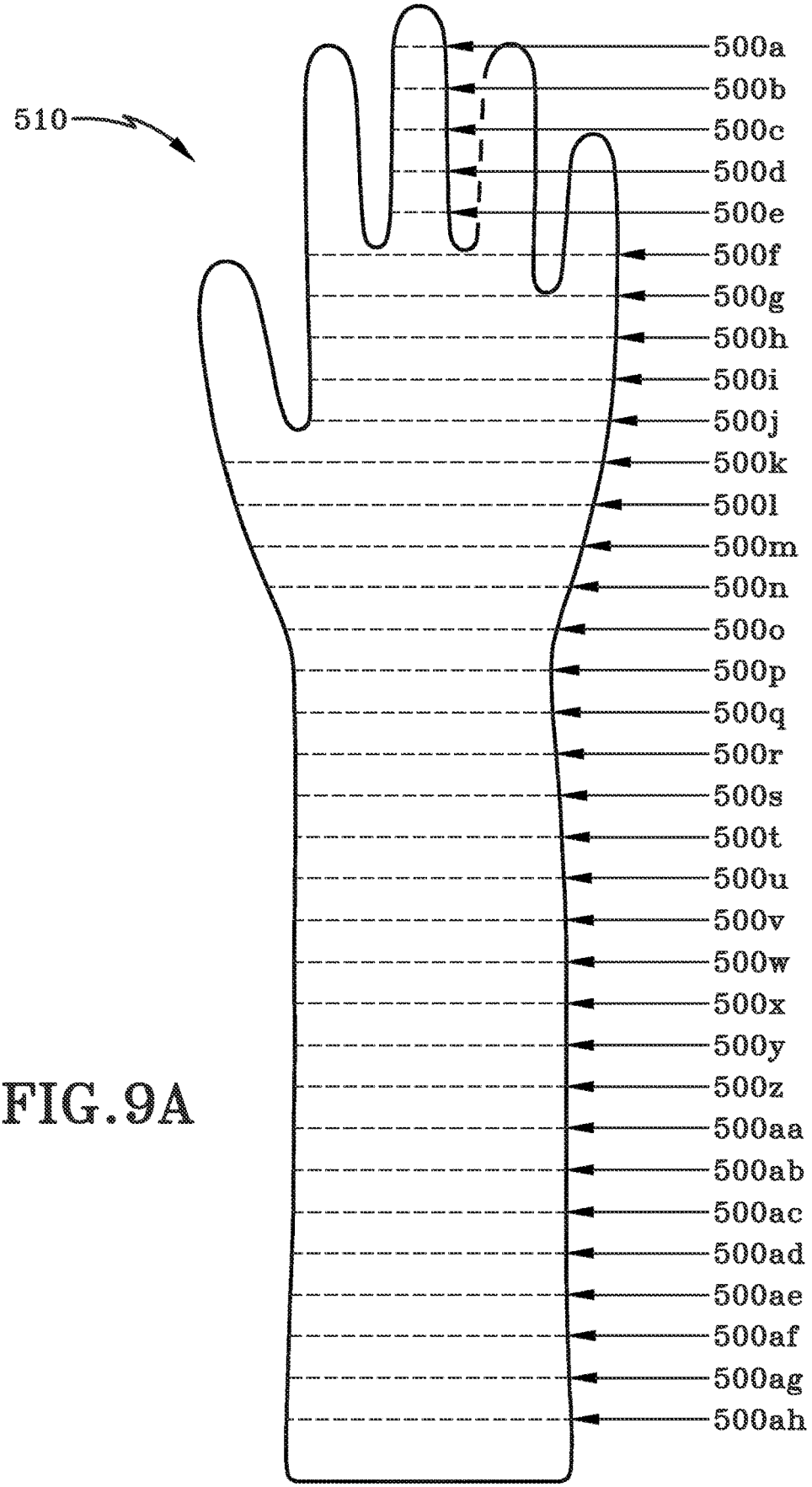
FIG. 9A is a front elevation view of a former for fabricating a Size 8 glove in accordance with an aspect of the present disclosure.
Figure 9B:
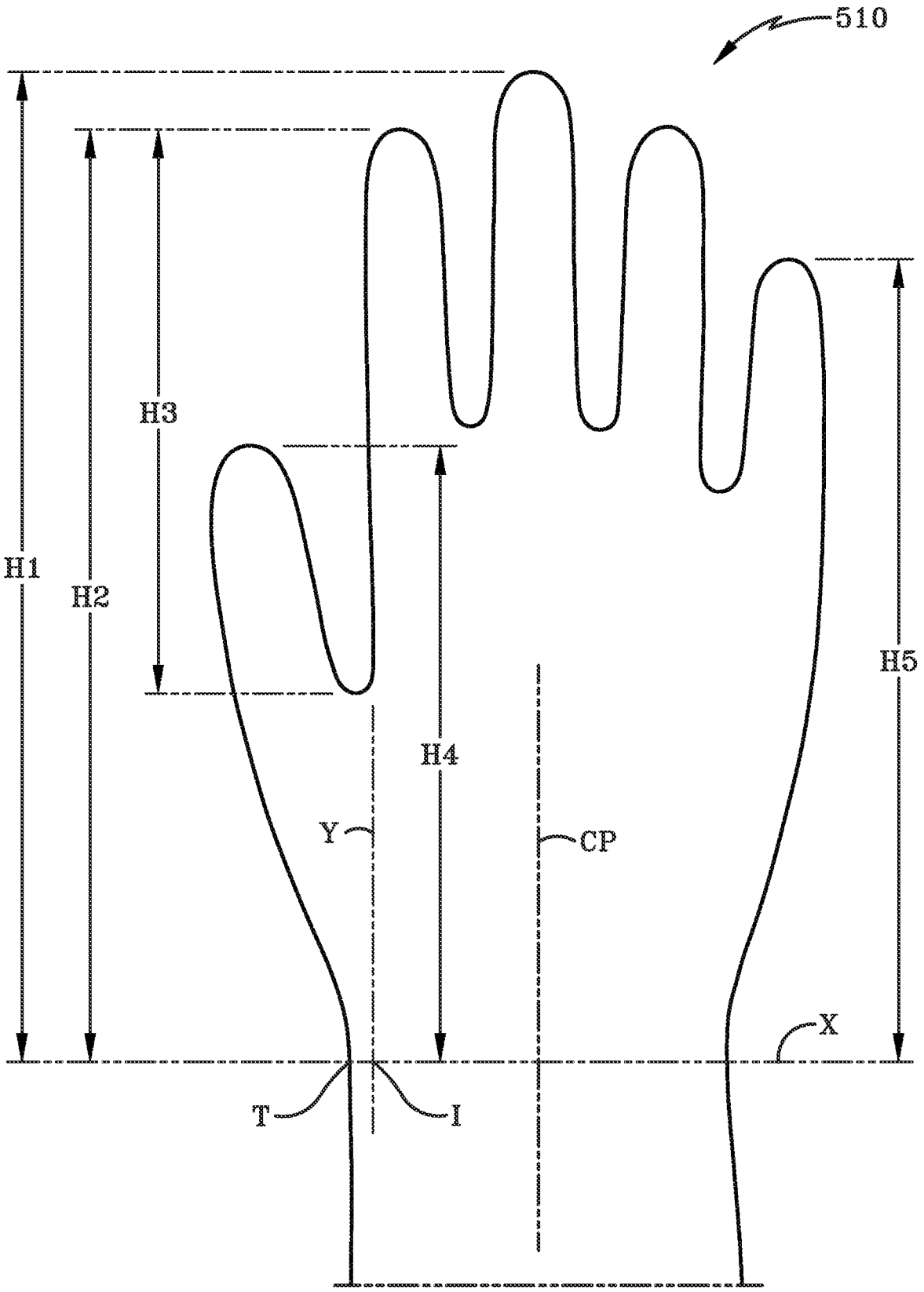
FIG. 9B is a partial enlarged front elevation view of the former of FIG. 9A.

FIGS. 9A and 9B show a former 510 for fabricating a size 8 or Medium glove in accordance with the present disclosure. The circumferences of various regions of the former 510 are identified in FIG. 9A by the reference characters 400*a* through 400*ah*. Measurements were taken of former 510 every half inch from the uppermost tip of a middle finger region of former 510 through to a base of the former located half an inch below the measurement identified at 400*ah*. Table 3, hereafter, identifies the reference characters 400*a* through 400*ah* and the particular circumference of the portion of the former that was measured. The particular portion of the former 510 that was measured is identified by the dashed lines in FIG. 9A. FIG. 9B shows various length measurements "H1" through "H5" of the upper part of the former 510. The measurements are taken relative to the imaginary plane "X" which is the equivalent of the imaginary plane "X" on FIGS. 3A through 6. The measurements "H1" through "H5" will be discussed later herein.

Figure 10A:
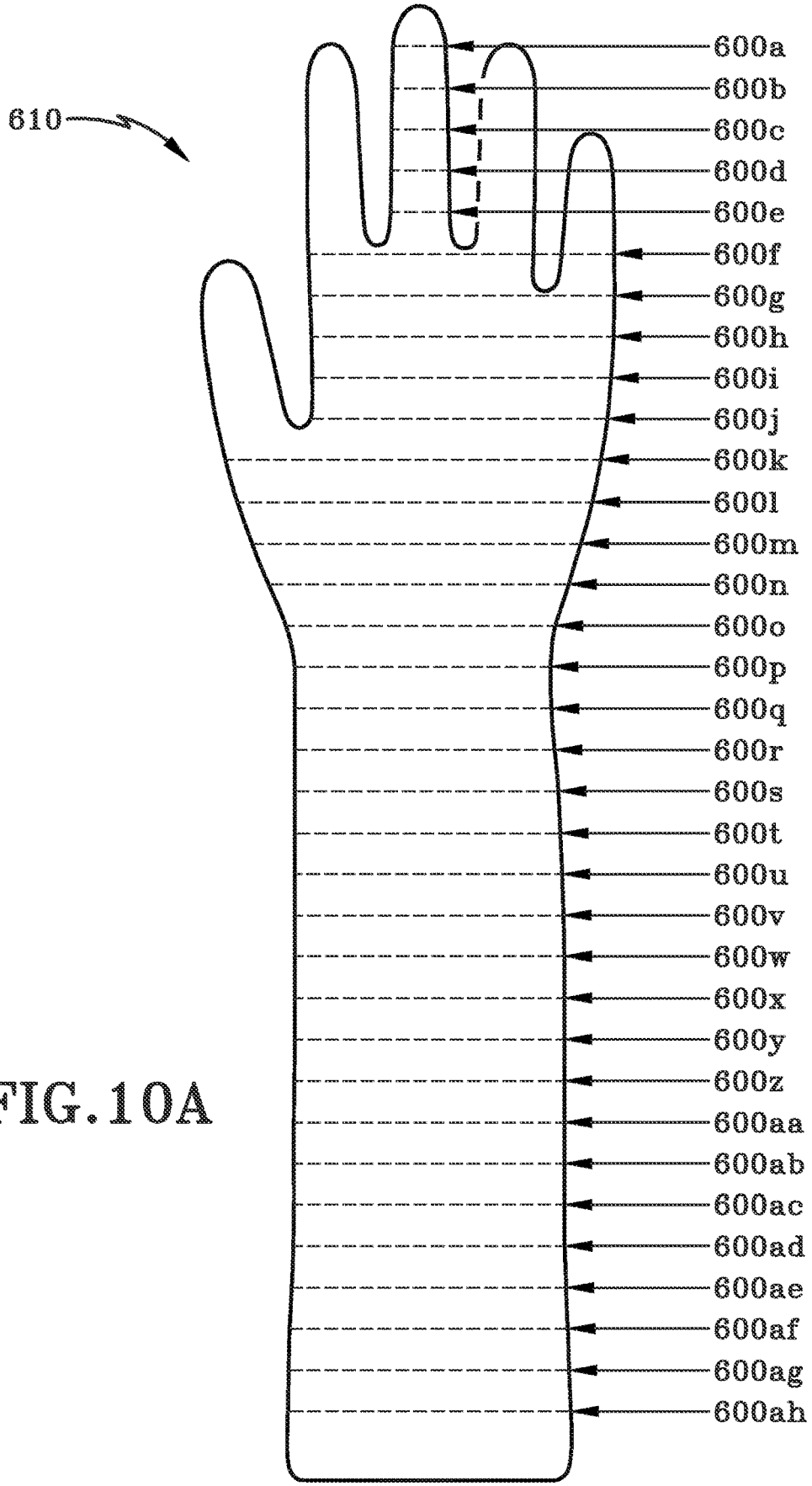
FIG. 10A is a front elevation view of a former for fabricating a Size 9 glove in accordance with an aspect of the present disclosure.
Figure 10B:
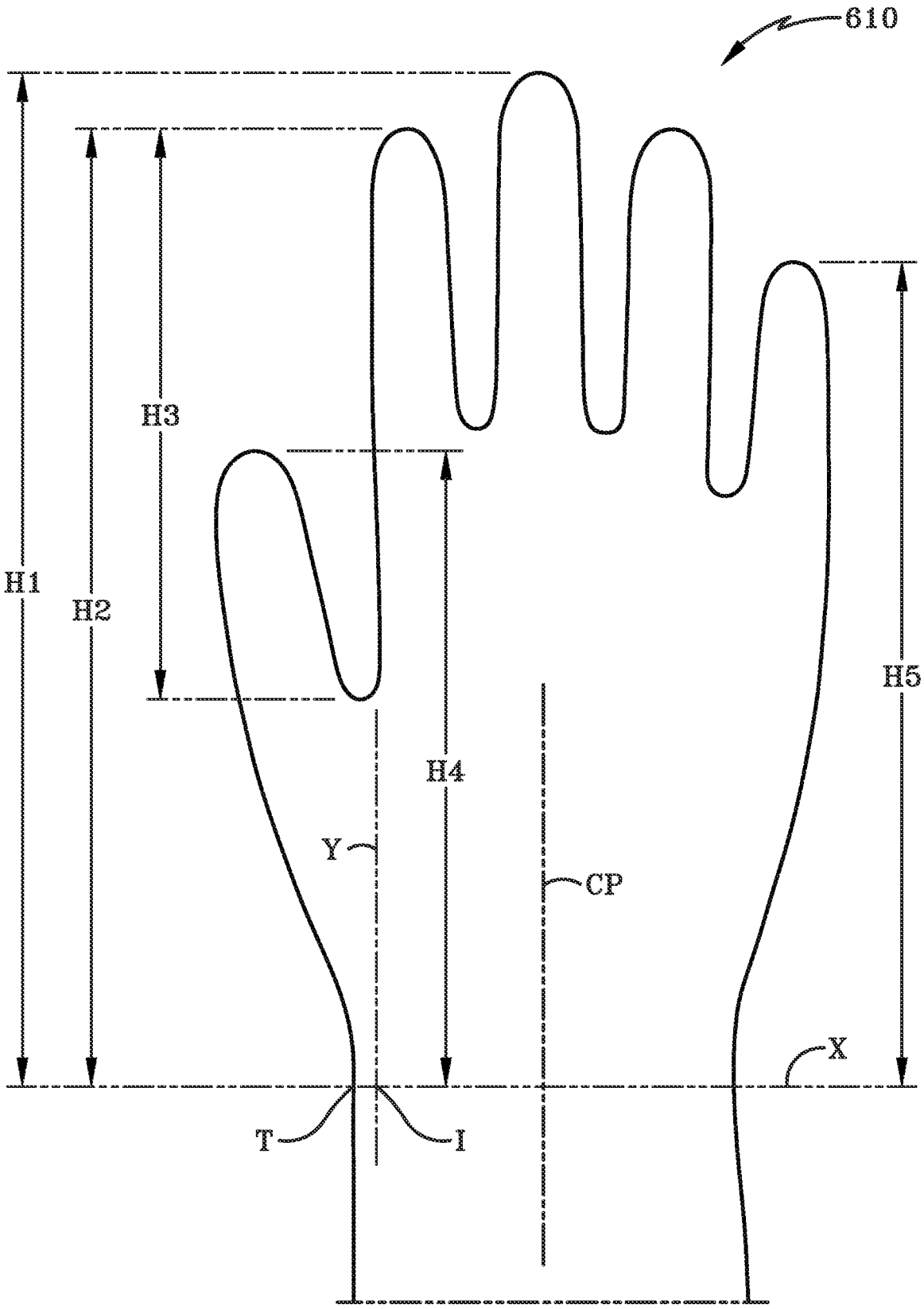
FIG. 10B is a partial enlarged front elevation view of the former of FIG. 10A.

FIGS. 10A and 10B show a former 610 for fabricating a size 9 or "Large" glove in accordance with the present disclosure. The circumferences of various regions of the former 610 are identified in FIG. 10A by the reference characters 600*a* through 600*ah*. Measurements were taken of former 610 every half inch from the uppermost tip of a middle finger region of former 610 through to a base of the former located half an inch below the measurement identified at 600*ah*. Table 4, hereafter, identifies the reference characters 400*a* through 400*ah* and the particular circumference of the portion of the former that was measured. The particular portion of the former 610 that was measured is identified by the dashed lines in FIG. 10A. FIG. 10B shows various length measurements "H1" through "H5" of the upper part of the former 610. The measurements are taken relative to the imaginary plane "X" which is the equivalent of the imaginary plane "X" on FIGS. 3A through 6. The measurements "H1" through "H5" will be discussed later herein.

TABLE 3

| Size 8 (Medium) Glove Former shown in FIGS. 9A and 9B | |
|---|---|
| Reference Character | Measurement in mm |
| 500a | 65 |
| 500b | 72 |
| 500c | 76 |
| 500d | 78 |
| 500e | 81 |
| 500f | 232 |
| 500g | 238 |
| 500h | 239 |
| 500i | 241 |
| 500j | 242 |
| 500k | 289 |
| 500l | 277 |
| 500m | 258 |
| 500n | 243 |
| 500o | 234 |
| 500p | 227 |
| 500g | 234 |
| 500r | 244 |
| 500s | 253 |
| 500t | 259 |
| 500u | 267 |
| 500v | 272 |
| 500w | 274 |
| 500x | 275 |
| 500y | 275 |
| 500z | 275 |
| 500aa | 275 |
| 500ab | 275 |
| 500ac | 275 |
| 500ad | 276 |
| 500ae | 277 |
| 500af | 279 |
| 500ag | 280 |
| 500ah | 281 |

TABLE 4

| Size 9 (Large) Glove Former shown in FIGS. 10A and 10B | |
|---|---|
| Reference Character | Measurement in mm |
| 600a | 71 |
| 600b | 78 |
| 600c | 82 |
| 600d | 85 |
| 600e | 88.5 |
| 600f | 243 |
| 600g | 247 |
| 600h | 250 |
| 600i | 255 |
| 600j | 257 |
| 600k | 306 |
| 600l | 292 |
| 600m | 280 |
| 600n | 259 |
| 600o | 246 |
| 600p | 237 |
| 600g | 238 |
| 600r | 245 |
| 600s | 255 |
| 600t | 265 |
| 600u | 276 |
| 600v | 282 |
| 600w | 284 |
| 600x | 285 |
| 600y | 285 |
| 600z | 285 |
| 600aa | 285 |
| 600ab | 285 |
| 600ac | 285 |
| 600ad | 284 |

TABLE 4-continued

| Size 9 (Large) Glove Former shown in FIGS. 10A and 10B | |
|---|---|
| Reference Character | Measurement in mm |
| 600ae | 284 |
| 600af | 284 |
| 600ag | 284 |
| 600ah | 284 |

Figure 11A:
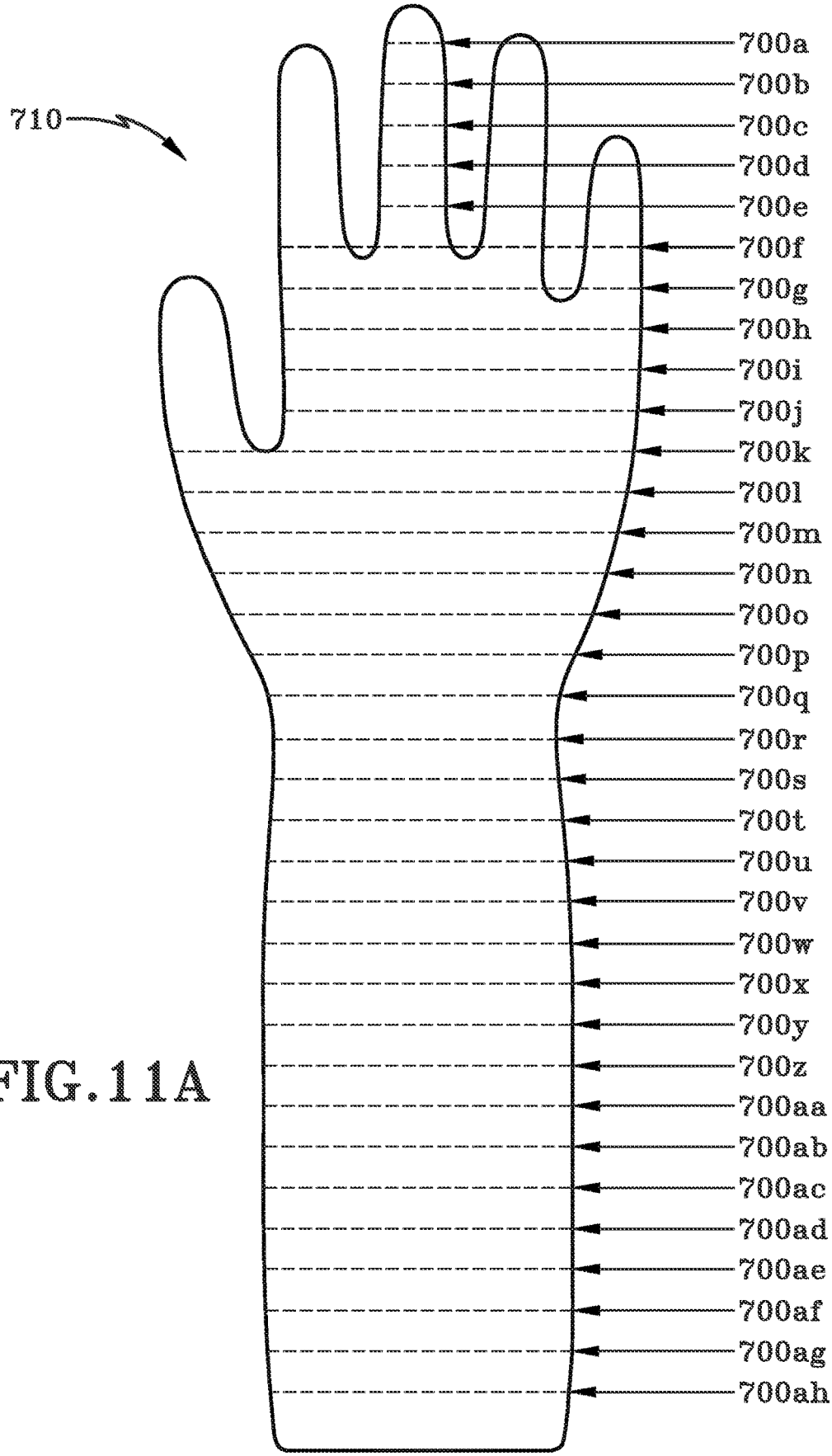
FIG. 11A is a front elevation view of a former for fabricating a Size 10 glove in accordance with an aspect of the present disclosure.
Figure 11B:
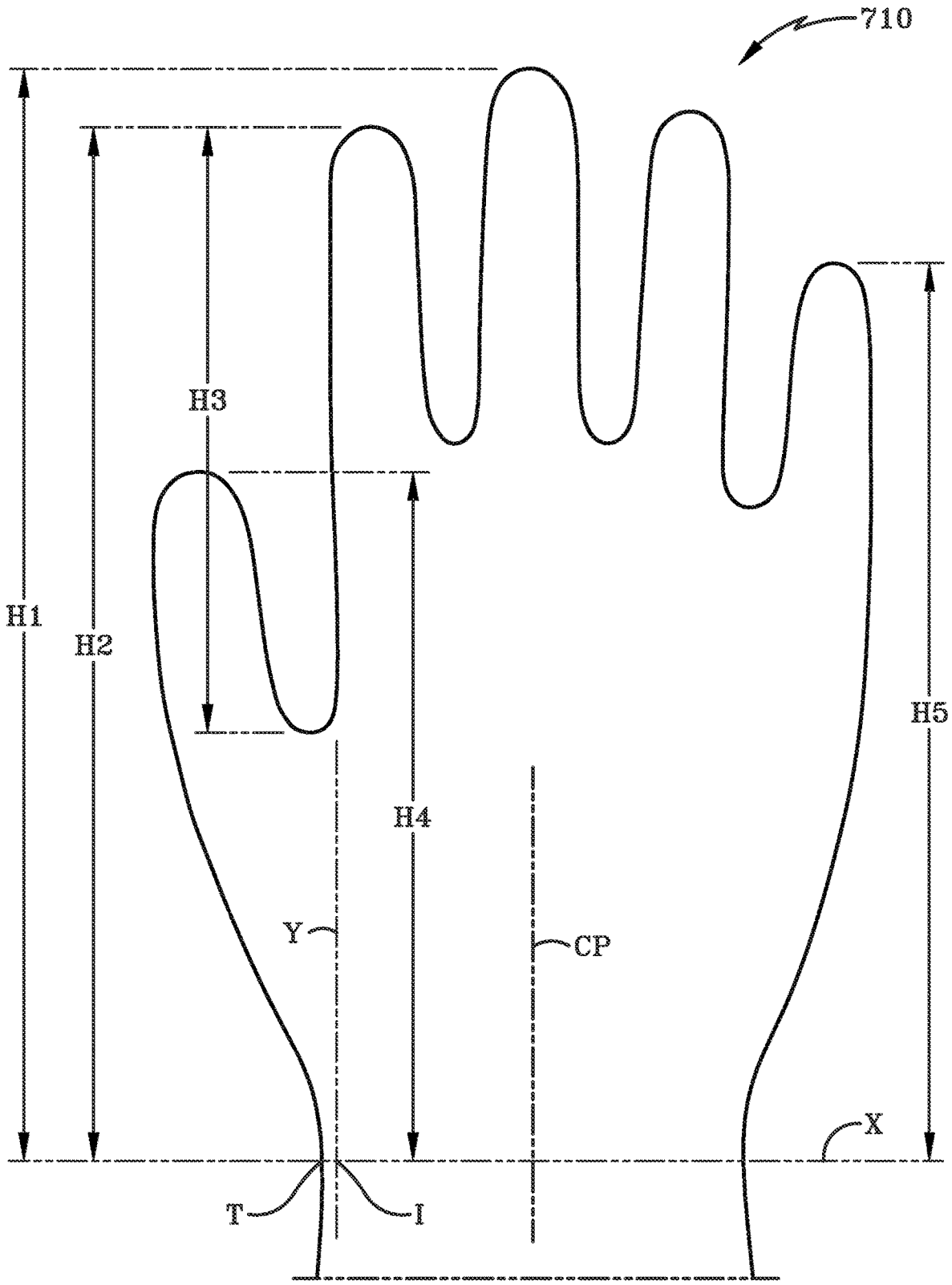
FIG. 11B is a partial enlarged front elevation view of the former of FIG. 11A.

FIGS. 11A and 11B show a former 710 for fabricating a size 10 or X-Large glove in accordance with the present disclosure. The circumferences of various regions of the former 710 are identified in FIG. 11A by the reference characters 700*a* through 700*ah*. Measurements were taken of former 710 every half inch from the uppermost tip of a middle finger region of former 710 through to a base of the former located half an inch below the measurement identified at 700*ah*. Table 5, hereafter, identifies the reference characters 700*a* through 700*ah* and the particular circumference of the portion of the former that was measured. The particular portion of the former 710 that was measured is identified by the dashed lines in FIG. 11A. FIG. 11B shows various length measurements "H1" through "H5" of the upper part of the former 710. The measurements are taken relative to the imaginary plane "X" which is the equivalent of the imaginary plane "X" on FIGS. 3A through 6. The measurements "H1" through "H5" will be discussed later herein.

Figure 12A:
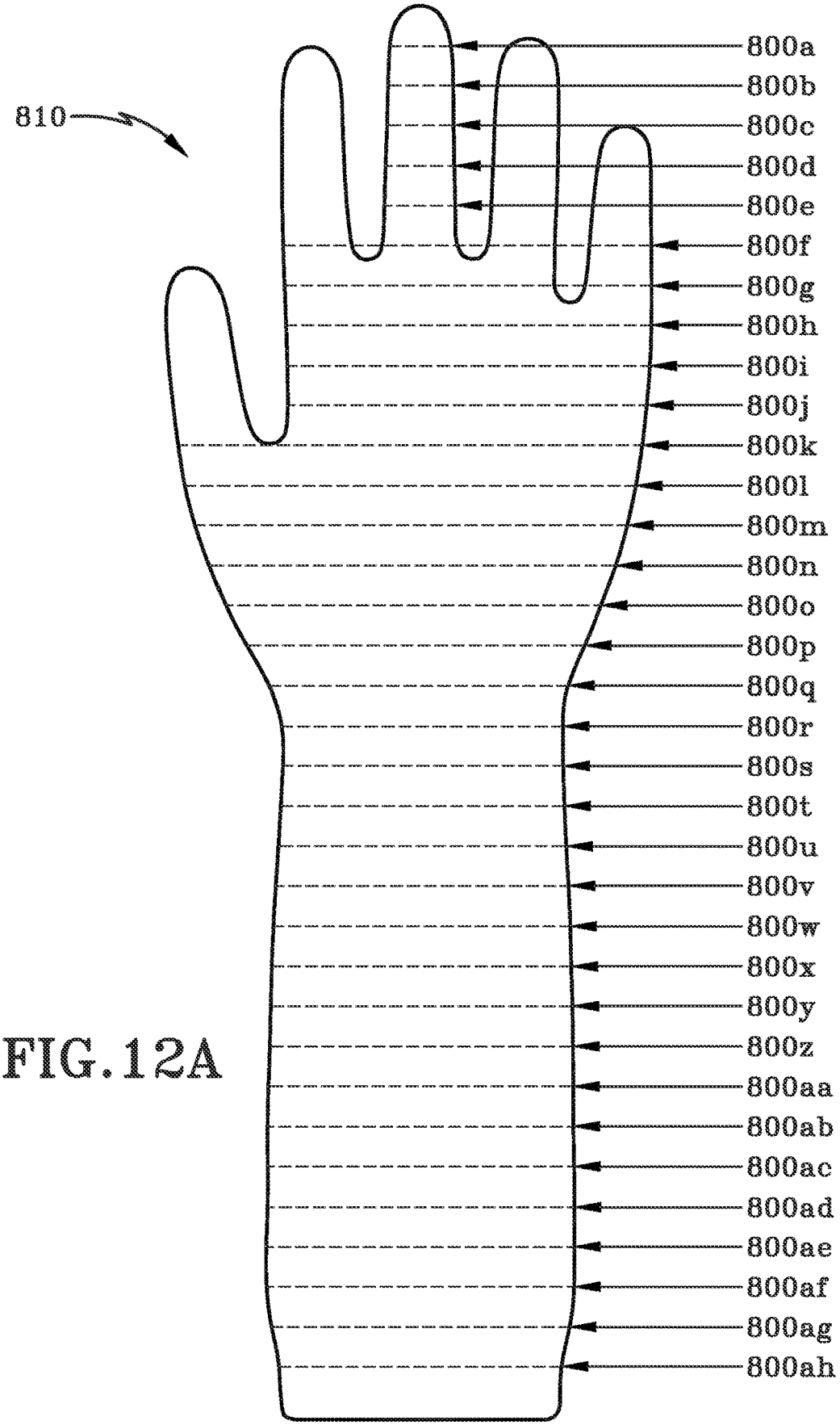
FIG. 12A is a front elevation view of a former for fabricating a Size 11 glove in accordance with an aspect of the present disclosure.
Figure 12B:
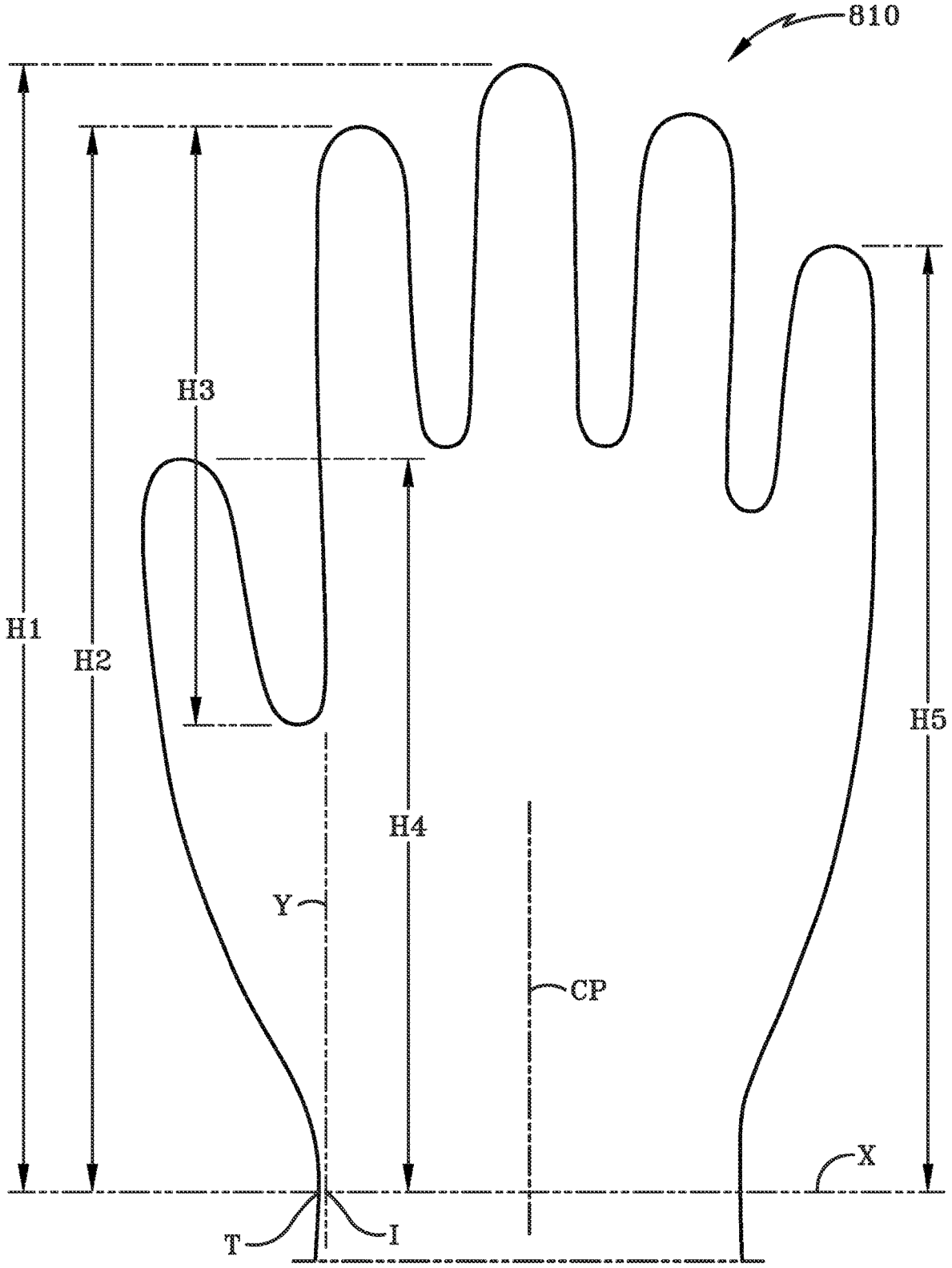
FIG. 12B is a partial enlarged front elevation view of the former of FIG. 12A.

FIGS. 12A and 12B show a former 810 for fabricating a size 11 or an XX-Large glove in accordance with the present disclosure. The circumferences of various regions of the former 810 are identified in FIG. 12A by the reference characters 800*a* through 800*ah*. Measurements were taken of former 810 every half inch from the uppermost tip of a middle finger region of former 810 through to a base of the former located half an inch below the measurement identified at 800*ah*. Table 6, hereafter, identifies the reference characters 800*a* through 800*ah* and the particular circumference of the portion of the former that was measured. The particular portion of the former 810 that was measured is identified by the dashed lines in FIG. 12A. FIG. 12B shows various length measurements "H1" through "H5" of the upper part of the former 810. The measurements are taken relative to the imaginary plane "X" which is the equivalent of the imaginary plane "X" on FIGS. 3A through 6. The measurements "H1" through "H5" will be discussed later herein.

TABLE 5

| Size 10 (X-Large) Glove Former shown in FIGS. 11A and 11B | |
|---|---|
| Reference Character | Measurement in mm |
| 700a | 71 |
| 700b | 78 |
| 700c | 82 |
| 700d | 85 |
| 700e | 89 |
| 700f | 267 |
| 700g | 269 |
| 700h | 273 |
| 700i | 276 |
| 700j | 280 |
| 700k | 340 |
| 700l | 330 |
| 700m | 318 |

TABLE 5-continued

| Size 10 (X-Large) Glove Former shown in FIGS. 11A and 11B | |
|---|---|
| Reference Character | Measurement in mm |
| 700n | 302 |
| 700o | 291 |
| 700p | 275 |
| 700g | 253 |
| 700r | 250 |
| 700s | 258 |
| 700t | 269 |
| 700u | 275 |
| 700v | 290 |
| 700w | 300 |
| 700x | 300 |
| 700y | 304 |
| 700z | 306 |
| 700aa | 305 |
| 700ab | 305 |
| 700ac | 305 |
| 700ad | 305 |
| 700ae | 305 |
| 700af | 304 |
| 700ag | 300 |
| 700ah | 290 |

TABLE 6

| Size 11 (XX-Large) Glove Former shown in FIGS. 12A and 12B | |
|---|---|
| Reference Character | Measurement in mm |
| 800a | 73 |
| 800b | 83 |
| 800c | 87 |
| 800d | 90 |

TABLE 6-continued

| Size 11 (XX-Large) Glove Former shown in FIGS. 12A and 12B | |
|---|---|
| Reference Character | Measurement in mm |
| 800e | 93 |
| 800f | 279 |
| 800g | 279 |
| 800h | 281 |
| 800i | 285 |
| 800j | 289 |
| 800k | 351 |
| 800l | 343 |
| 800m | 337 |
| 800n | 320 |
| 800o | 300 |
| 800p | 285 |
| 800q | 266 |
| 800r | 260 |
| 800s | 264 |
| 800t | 272 |
| 800u | 280 |
| 800v | 289 |
| 800w | 300 |
| 800x | 306 |
| 800y | 310 |
| 800z | 314 |
| 800aa | 314 |
| 800ab | 314 |
| 800ac | 314 |
| 800ad | 315 |
| 800ae | 315 |
| 800af | 317 |
| 800ag | 306 |
| 800ah | 290 |

Table 7 below identifies various regions of each of the size 6 through size 11 glove formers illustrated in FIGS. 7A through 12A and the measurements of particular regions thereof.

TABLE 7

| Size of Former (Measured in mm) | | | | | | | |
|---|---|---|---|---|---|---|---|
| Glove Size | Variation | FIG.7A 6 | FIG.8A 7 | FIG.9A 8 | FIG.10A 9 | FIG.11A 10 | FIG.12A 11 |
| Total Height | ±5 mm | 450 | 450 | 450 | 450 | 450 | 450 |
| Palm Circumference (10 mm above thumb crotch) | ±4 mm | 214 | 234 | 245 | 255 | 280 | 290 |
| Wrist Circumference | ±4 mm | 194 | 220 | 228 | 235 | 250 | 260 |
| Shank Circumference | ±4 mm | 253 | 266 | 275 | 284 | 304 | 313 |
| Width of Hand | | 107 | 118 | 132.5 | 132.5 | 150 | 154 |
| Length of Hand | | 180 | 190 | 199 | 205 | 220 | 220 |
| KL Finger Length (Vertical) | | 112.5 | 111 | 116.5 | 118 | 126.5 | 126.5 |
| Thumb | ±3 mm | 43.5 | 45.5 | 51 | 52.5 | 54.5 | 56.5 |
| Index | ±3 mm | 56 | 58 | 62 | 64 | 66 | 67 |
| Middle | ±3 mm | 70 | 72 | 74 | 75 | 78 | 80 |
| Ring | ±3 mm | 60.5 | 62 | 63 | 65.5 | 69.5 | 70.5 |
| Little | ±3 mm | 45 | 46 | 48.5 | 50 | 51 | 56 |
| Finger Circumference (Middle of finger) | | | | | | | |
| Thumb | ±3 mm | 74 | 75 | 76 | 78 | 82 | 84 |
| Index | ±3 mm | 67.5 | 68.5 | 72 | 73.5 | 79.5 | 81.5 |
| Middle | ±3 mm | 73 | 74 | 76 | 81 | 84 | 88 |

TABLE 7-continued

| Size of Former (Measured in mm) | | | | | | | |
|---|---|---|---|---|---|---|---|
| Glove Size | Variation | FIG.7A 6 | FIG.8A 7 | FIG.9A 8 | FIG.10A 9 | FIG.11A 10 | FIG.12A 11 |
| Ring | ±3 mm | 67 | 69 | 72.5 | 75 | 79 | 84 |
| Little | ±3 mm | 57.5 | 59.5 | 62.5 | 65.5 | 69.5 | 72.5 |

Table 8 shown below displays the various lengths "H1" through "H5" of the gloves size 6 through 11 shown in FIGS. 7B, 8B, 9B, 10B, 11B, and 12B. The lengths "H1" through "H5" are measured in millimeters.

TABLE 8

| Heights of various regions of the formers for gloves 150, 250 (Measured in mm) | | | | | | |
|---|---|---|---|---|---|---|
| SIZE | FIG.7B 6 | FIG.8B 7 | FIG.9B 8 | FIG.10B 9 | FIG.11B 10 | FIG.12B 11 |
| H1 | 209 | 213 | 208 | 226 | 221 | 239 |
| H2 | 194 | 202 | 197 | 212 | 209 | 226 |
| H3 | 113 | 109 | 117 | 118 | 124 | 125 |
| H4 | 127 | 138 | 130 | 144 | 140 | 157 |
| H5 | 173 | 174 | 165 | 185 | 181 | 201 |

TABLE 9

| Equivalent Heights of various regions of PRIOR ART gloves 10 (Measured in mm) (No data was available for the size 11 PRIOR ART glove 10) | | | | | |
|---|---|---|---|---|---|
| SIZE | 6 | 7 | 8 | 9 | 10 |
| H1 | 200 | 205 | 210 | 220 | 220 |
| H2 | 185 | 195 | 200 | 205 | 205 |
| H3 | 110 | 115 | 120 | 120 | 120 |
| H4 | 125 | 135 | 140 | 145 | 145 |
| H5 | 160 | 165 | 170 | 175 | 180 |

TABLE 10

| Comparison of Widths of PRIOR ART glove 10 (PAG-10) relative to glove 150 (G-150) taken along imaginary planes "X1", "X", and "X2" (Measured in mm) | | | | | |
|---|---|---|---|---|---|
| SIZE | 6 | 7 | 8 | 9 | 10 |
| "X1" - PAG-10 | 123 | 137 | 140 | 145 | 150 |
| "X1" - G-150 | 126 | 139 | 144.5 | 153 | 170 |
| "X" - PAG-10 | 86 | 92 | 95 | 100 | 100 |
| "X" - G-150 | 98.5 | 110 | 113.5 | 118.5 | 125 |
| "X2" - PAG-10 | 100 | 102 | 105 | 110 | 110 |
| "X" - G-150 | 127 | 133.5 | 137.5 | 142.5 | 150 |

Relative to the width of the Size 6 through Size 10 PRIOR ART gloves 10 taken along imaginary axis "X1", the width of the Size 6 through Size 10 glove 150 is 2.4%, 1.4%, 3.1%, 5.2%, and 11.8% wider, respectively. In other words, the width of glove 150 taken along imaginary axis "X1" is in the range of from about 1.4% up to about 11.8% wider.

Relative to the width "W" of Size 6 through Size 10 PRIOR ART gloves 10, the width "W" of Size 6 through Size 10 gloves 150 in accordance with the present disclosure is 13%, 16.4%, 16.3%, 15.6%, and 20% wider, respectively. In other words, the narrowest width "W" of glove 10 is in the range of from about 13% up to about 20% wider than the narrowest width "W" of PRIOR ART gloves 10.

Relative to the width of the bottom end 12*a* of the Size 6 through Size 10 PRIOR ART gloves 10, the width of the bottom end 152*a* of the glove 150 is 21.3%, 23.6%, 23.6%, 22.6%, and 26.7% wider, respectively. In other words, the bottom edge width of glove 10 is in the range of from about 21.3% up to about 26.7% wider than the width of the bottom edge 12*a* of PRIOR ART glove 10.

TABLE 10

| Comparison of the dimensions "L1" and "L2" of PRIOR ART glove 10 (PAG-10) relative to glove 150 (G-150) | | | | | |
|---|---|---|---|---|---|
| SIZE | 6 | 7 | 8 | 9 | 10 |
| "L1" - PAG-10 | 90 | 85 | 90 | 90 | 107 |
| "L1" - G150 | 96 | 92 | 97 | 79 | 84 |
| "L2" - PAG-10 | 75 | 80 | 80 | 85 | 85 |
| "L2" - G150 | 81 | 93 | 80 | 94 | 85 |

It should be noted that PRIOR ART glove 10 varies in overall length. Size 6 is 310 mm, Size 7 is 305 mm, Size 8 is 300 mm, Size 9 is 295 mm, and Size 10 is 305 mm. All of the glove sizes for the glove 150 are 305 mm. These differences in sizes have been used in the calculation of the two dimensions "L!" and "L2" listed in Table 10.

Relative to the length "L1" of the wrist region of Size 6 through Size 10 PRIOR ART gloves 10 (measured between imaginary planes "X2" and "X", the length "L1" of the Size 6 through Size 8 gloves 150 is increased by 6.25%, 7.6%, and 7.2%, respectively. The size 9 and Size 10 lengths "L1", on the other hand have decreased in size by −12.7% and −21.5%, respectively. Data for a PRIOR ART glove, Size 11 was not available.

Relative to the length "L2" of the Size 6 through Size 10 PRIOR ART gloves 10 (measured between imaginary planes "X" and "X1", the distance between the thumb crotch and the narrowest width "W" of the wrist region in the Size 6 through Size 10 glove 150 is 7.4%, 14%, 0%, 9.6%, 0% larger, respectively. In other words, apart from the Size 8 and Size 10 gloves, the distance between the thumb crotch and the narrowest width "W" of the glove 15 is from about 7.4% and 14% larger than in the PRIOR ART gloves 10. Data for a PRIOR ART glove, Size 11 was not available.

A review of the data of Table 10 shows that, relatively speaking, the widening of the wrist region 152 between first side 152*b* and second side 152*c* has the effect of decreasing the overall distance between the lowest region 170*a* of thumb crotch 170 and the region of the wrist region 152 that is of the narrowest width "W" for the Size 6, Size 7, and Size 8 gloves 150 relative to the PRIOR ART gloves 10. The reverse is true for the larger size gloves. In the Size 9, and Size 10 gloves, the overall distance between the lowest region 170*a* of thumb crotch 170 and the narrowest width "W" decreased relative to PRIOR ART gloves 10.

In other embodiments, the glove in accordance with the present disclosure may be formed with a deeper thumb crotch than in PRIOR ART glove 10. In other words, the length of at least the first side 162*a* of the index finger region 162 may be increased to place the lowest region 170*a* of thumb crotch 170 closer to the imaginary plane "X" than the equivalent locations in the PRIOR ART glove 10. Changing this feature in the glove 150 helps to relieve stress in a parts of the glove that extend across upper end of the back region 154 and palm region 156 at the base of the finger regions 162 through 168. This arrangement makes it easier for the person wearing the glove to grip objects or make a fist.

A method of using glove 150 or 250 in accordance with the present disclosure in a processing operation such as in a meat packing or processing plant or in a chemical processing plant includes steps of selecting an appropriately-sized glove 150 (or 250) for a person's hand as previously described herein. Glove 150 comprises a body defining an interior cavity 150*a* for receiving the person's hand "LH", wherein the body includes a thumb region 160, an index finger region 162 having a first side 162*a* that together with a first side 160*a* of the thumb region 160 defines a thumb crotch 170 therebetween. The body of the glove 150 further includes a wrist region 152. An imaginary first plane "Y" extends generally along the first side 162*a* of the index finger region 162, downwardly beyond the thumb crotch 170, and through the thumb region 160 that is located below thumb crotch 170 along imaginary first plane "Y". An imaginary second plane "X" is oriented at right angles to the imaginary first plane "Y" and extends along a narrowest width "W" of the wrist region 152. The imaginary first plane "Y" and imaginary second plane "X" intersect one another at an intersection region "I". An imaginary third plane is oriented parallel to the imaginary first plane "Y" and at right angles to the imaginary second plane "X", said imaginary third plane passes through narrowest width "W" of the wrist region 152. In FIG. 3A, the imaginary third plane is illustrated as the center plane "CP" but it will be understood that glove 150 may include any other third plane that extends parallel to the imaginary first plane "Y" and is oriented at right angles to the imaginary second plane "X" and passes through the narrowest width "W" of the wrist region 152. The imaginary second plane "X" intersects the wrist region 152 at a transition region "T"; and the transition region "T" is located outwardly from the intersection region "I" in a direction moving away from the imaginary third plane ("CP") and towards the imaginary first plane "Y". The method includes inserting the person's hand "LH" into the interior cavity 150*a* of the body of the glove 150; spacing at least the person's wrist a distance away from an interior surface of the wrist region 152 (as illustrated in FIG. 3A); performing a task while wearing the glove 150; and removing the glove 150 after performing of the task.

The method further includes fabricating the body of the glove 150 from one or more of latex, nitrile, and natural rubber having a thickness in the range of from about 4 mils up to about 15 mils, wherein the thickness is measured from an exterior surface of the body to the interior surface thereof.

The method further comprises steps of allowing a period of time to pass after removing the glove 150; pulling the previously-removed glove 150 back onto the person's hand "LH"; and performing another task while wearing the previously-removed glove 150. These steps may be repeated multiple e times over the course of a work shift. The repetition of these steps may occur in a single work shift which may last, for example from about seven hours up to about ten hours.

The method further comprises pulling the previously-removed glove 150 off the person's hand "LH" for a final time when the work shift has ended; and then disposing of the glove 150. The disposing may include throwing the glove in the garbage or in a hazardous waste collection bin, or recycling the glove if possible.

The step of removing the glove 150 from the person's hand may be accomplished by grasping one or more finger-tip regions of the finger regions 162, 164, 166, 168, and/or a tip 160*c* of the thumb region 160 and pulling thereon in a direction moving outwardly away from the person's fingers and or thumb until the body of the glove 150 slides off the person's hand "LH".

The method may further comprise providing a long sleeve 22 that extends over the person wrist; and pulling the wrist region 152 of the glove 150 over part of the sleeve 22. This is shown in FIGS. 3A and 5A.

Figure 3B:
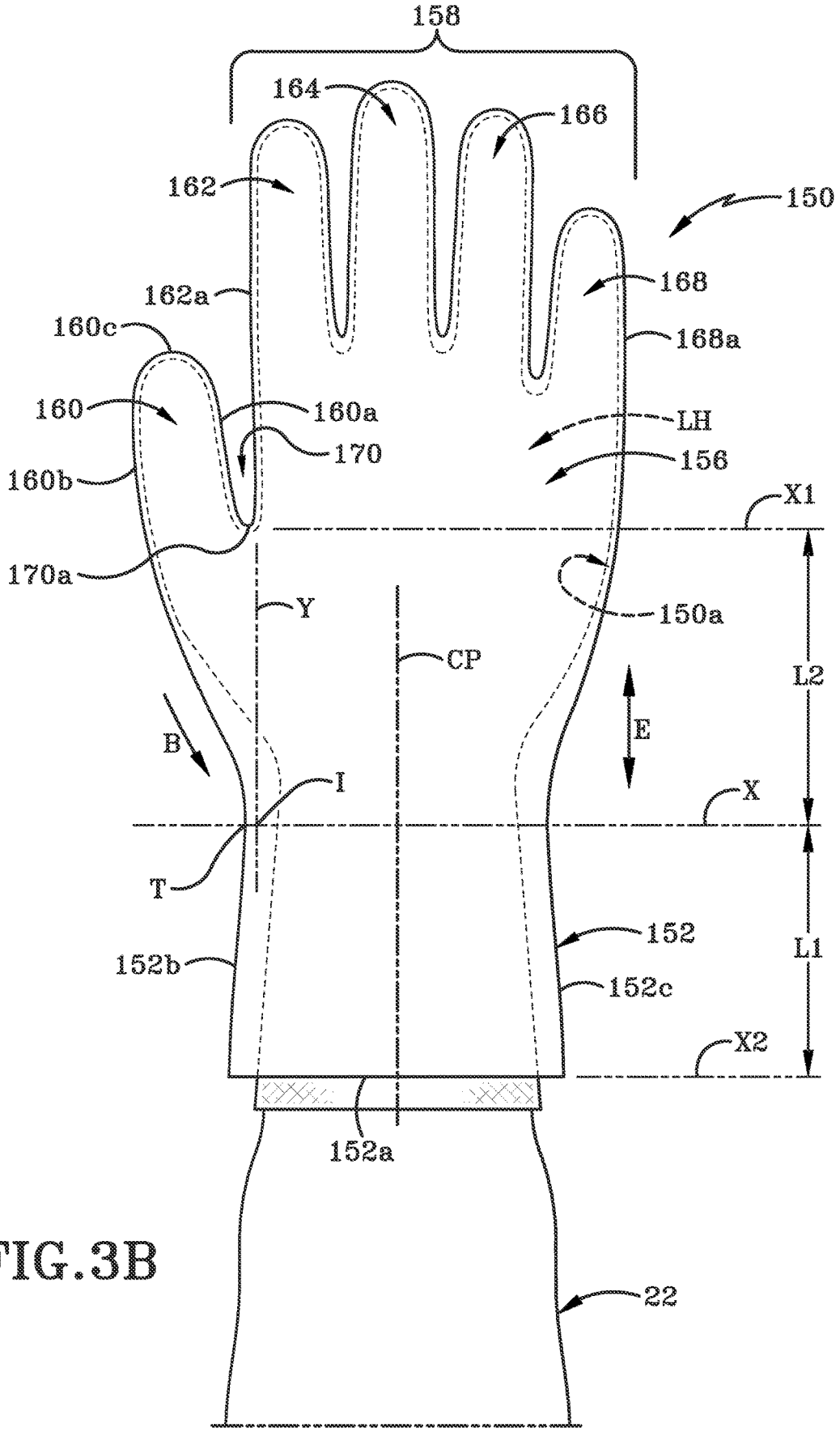
FIG. 3B is a front elevation view of the glove of FIG. 3A pulled over a liner worn on the person's hand.

The pulling on of the glove 150 may be preceded by pulling a closely-conforming liner 174 over the person's hand "LH" and then pulling the glove 150 over the liner 174 such that the person's hand is double-gloved. This is illustrated in FIGS. 3B and 5B. The method may further include performing the task with the double-gloved hand covered by liner 174 and glove 150. The method may further include removing the glove 150 from over the liner 174 after performing the task with the double-gloved hand, allowing a period of time to pass after removing the glove 150 from over the liner 174; pulling the glove 150 which was previously-used back onto the person's hand and over the liner 174 such that the person's hand is double-gloved once again; and performing another task while double-gloved. The method may include repeating the steps of removing the used glove 150 from over the liner 174, allowing the period of time to pass, pulling the previously-used glove back onto the person's hand over the liner, and performing another task while double-gloved multiple times over the course of the person's work shift. The work shift may last for an extended time period such as from about seven hours up to about ten hours in length.

The method may further comprise pulling the glove 150 that has been used multiple times off the person's hand from over the liner 174 for a final time when the person's work shift has ended; removing the liner 174 from the person's hand; and disposing of at least the glove 150. Obviously, the liner 174 may also be disposed of at that time or the liner 174 may be reused at the next work shift.

The method may also include removing the liner 174 from the person's hand after removing the glove 150 therefrom; replacing the liner 174 with another liner having different characteristics (e.g. exchanging a moisture-wicking liner with a cut-resistant liner); pulling the glove 150 back onto the person's hand over the another liner such that the person's hand is double-gloved once again; and performing another task with the double-gloved hand.

The method may further comprise throwing the glove away after a preset period of time. The preset time may be based on a number of factors. For example, in chemical plants it may be known that using any glove for more than a particular time leads to glove failure and therefore potential injury for the person wearing the glove. In such instances, all workers may be required to discard their gloves at a time well within the window of where glove failure may occur. In other instances, the processing plant may mandate that gloves must be thrown away at the end of a work shift, such as an eight hour work shift, to prevent possible cross-contamination of a product being processed.

The wider portion of the thumb region adjacent the thumb knuckles allows room for the person to ball up their hand, such as in making a fist, without undue pressure being exerted on the glove by the palm region. The wider wrist region tends to balloon over the balled up them when it is necessary to make a fist.

While glove 150 is illustrated and discussed herein as being an ambidextrous glove, it will be understood that a hand-specific glove may also include a widened wrist and the other features that are described below with respect to the ambidextrous version of glove 150.

As discussed earlier herein, the material used to fabricate glove 150 for the meat packing or meat processing industries is relatively thin, being from about 4 mils up to about 15 mils thick. Preferably the glove is from about 5 mils up to about 8 mils thick. Despite this thickness being considered to be relatively thin by industry standards, the configuration of the glove 150 makes it possible to reuse the glove if that is desired. Reusing previously known gloves of this thickness has not been possible for at least two reasons which have been touched upon briefly in the Background. PRIOR ART gloves frequently become reversed as they are pulled off because the person typically struggles to remove the narrow wrist region on the PRIOR ART glove from around their wrist. Removal is especially difficult if the wrist region is buried under the end of sleeve of a shirt or sweater or lab coat. Additionally, the tugging and pulling required to remove PRIOR ART gloves from the person's hand often leads to the material of the gloves becoming damaged or torn. The PRIOR ART gloves then have to be discarded. The presently disclosed gloves 150, by contrast, can be slid on and off a person's hand with relative ease, even if the person is wearing clothing with long sleeves. In particular, the gloves are pulled off by simply grasping the tips of the fingertip region and tip of the thumb region and pulling the glove in a direction moving away from the fingers. The widened wrist region 152 helps to ensure the glove will slide off the hand without becoming reversed.

In one embodiment, the glove 150 is not of a constant or uniform thickness from the tips of the fingertip regions 162 to 168 and thumb region 160 down to the bottom end 152*a* of the wrist region 152 or the cuff, if provided. In one embodiment, the finger regions are about 8 mils thick, the palm region is about 7 mils thick and the wrist is about 5 mils thick (or in the range of from about 4 mils thick up to about 11 mils thick.)

Additionally, the configuration of the presently disclosed glove 150 makes it possible to pull the glove on over a liner 174 that is already placed over the person's hand. This was difficult to accomplish with previously known gloves because friction between the liner and the very tight wrist region of the PRIOR ART gloves tends to cause the material of that glove, particularly the wrist region thereof, to be damaged as the person struggles to pull the PRIOR ART glove over the liner.

While the presently disclosed glove 150 makes it easier to pull the glove on and off, it should be understood that the glove's configuration still leaves the finger regions 162 to 168 and the outer end of the thumb region including the tip 160*c* (i.e., the region between the person's thumb joint "J" and the tip 160*c* of the person's thumb) in sufficiently close enough proximity to the person's fingers and thumb. This arrangement helps to maintain the person's dexterity and ability to grip objects while performing tasks at their job. In other words, the wider circumference of the wrist region remain in close enough proximity to the hand that the glove 150 will remain on the person's hand while they are performing a task. In other words, the glove 150 won't slide off the hand accidently provided the person has selected an appropriately-sized glove for their hand and has not moved up a glove size or two. The presently-disclosed glove can be used in the same manner as previously known gloves but the presently disclosed glove is easier to pull on and take off, particularly over liners 174 and long sleeved clothing 22. Additionally, the glove can be reused instead of having to be automatically discarded after a single use.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A glove comprising:

a body defining an interior cavity adapted to receive a person's hand therein, wherein the body is fabricated from one or more of nitrile and natural rubber;

wherein the body includes:

a thumb region adapted to receive the person's thumb therein;

an index finger region adapted to receive the person's index finger therein, wherein the index finger region has a first side that together with a first side of the thumb region defines a thumb crotch therebetween;

a wrist region adapted to receive the person's wrist therein;

wherein the body has an interior surface bounding and defining the interior cavity, and wherein the interior surface is flocked;

an imaginary first plane extending generally along the first side of the index finger region, downwardly beyond the thumb crotch, and through the thumb region;

an imaginary second plane oriented at right angles to the imaginary first plane and extending along a narrowest width of the wrist region; wherein the imaginary first plane and imaginary second plane intersect one another at an intersection region; and an imaginary third plane oriented parallel to the imaginary first plane and at right angles to the imaginary second plane, said imaginary third plane passing through the narrowest width of the wrist region;

wherein the imaginary second plane intersects a first side of the wrist region at a transition region; and wherein the transition region is located outwardly from the intersection region in a direction moving away from the imaginary third plane and towards the imaginary first plane;

wherein the body has an exterior surface including a front and a back of the glove; wherein texture is provided on gripping surfaces of each of the front and the back, and wherein the pattern of texture on the front is identical to the pattern of texture on the back;

wherein the exterior surface of the body is of a first color and the interior surface of the body is of a second color that is different from the first color; and wherein the wrist region terminates at a bottom end and the body has a first length measured from the bottom end to the intersection region and a second length measured from the intersection region to the thumb crutch, and wherein when the glove is laid on a flat surface, the first length is between 79 mm and 97 mm and the second length is between 80 mm and 94 mm, wherein the first length is adapted to cause the wrist region to extend over a long sleeve shirt worn by the person in a cooled meat processing environment.

2. The glove according to claim 1, wherein the imaginary third plane is a center plane passing generally through a center of the narrowest width of the wrist region such that the imaginary center plane is equidistant from a first side and a second side of the wrist region.

3. The glove according to claim 2, wherein the transition region is located at or proximate to the first side of the wrist region.

4. The glove according to claim 1, wherein the wrist region extends downwardly for a distance to a bottom end of the wrist region, and wherein the bottom end of the wrist region is located generally parallel to the imaginary second plane.

5. The glove according to claim 1, wherein the wrist region tapers inwardly from the bottom end and moving towards the imaginary second plane.

6. The glove according to claim 1, wherein the body includes a finger region comprising the index finger region, a middle finger region, a ring finger region, and a little finger region; and wherein the glove is an ambidextrous glove where the thumb region, the index finger region, the middle finger region, the ring finger region, and the little finger region are aligned along an imaginary common plane; and wherein the imaginary second plane is oriented at right angles to the imaginary common plane.

7. The glove according to claim 6, wherein the body is fabricated from a material having a thickness measured from the exterior surface of the body to the interior surface thereof, and wherein the body includes a palm region and a back region interposed between the finger region and the wrist region, wherein the finger region is about 8 mils thick, the palm region and back region are about 7 mils thick, and the wrist region is about 5 mils thick.

8. The glove according to claim 1, wherein the body is fabricated from a material having a thickness in a range of from about 4 mils up to about 15 mils, wherein the thickness is measured from the exterior surface of the body to the interior surface thereof.

9. The glove according to claim 1, wherein the one or more of nitrile and natural rubber includes one or more materials that improve a strength, a cut-resistance, and a protection to the person's hand received within the interior cavity of the glove.

10. The glove according to claim 1, wherein when the glove is laid on a flat surface the narrowest width of the glove is between 98.5 mm to 130 mm.

11. The glove according to claim 1, wherein when the glove is laid on the flat surface, a bottom end of the wrist region is of a width of between 127 mm and 150 mm.

12. The glove according to claim 1, further comprising a rolled cuff extending outwardly from the wrist region in a direction opposite to the palm region, wherein the rolled cuff displays the second color of the interior surface of the glove adjacent the first color of the exterior surface of the glove.

13. A glove comprising:

a body defining an interior cavity adapted to receive a person's hand and wrist therein, wherein the body is fabricated from one or more of nitrile and natural rubber having a thickness in a range of from about 4 mils up to about 15 mils, wherein the thickness is measured from an exterior surface of the body to an interior surface thereof, and wherein the glove is reusable;

wherein the body includes:

a palm region and a back region opposed to the palm region;

a thumb region and a finger region extending outwardly from the palm region and the back region, wherein the finger region includes an index finger region having a first side that together with a first side of the thumb region defines a thumb crotch therebetween;

a wrist region extending downwardly from the palm region and the back region, said wrist region having a narrowest width that extends between a first side of the wrist region and a second side of the wrist region;

wherein the body has an interior surface bounding and defining the interior cavity, and wherein the interior surface is flocked;

an imaginary first plane extending generally along the first side of the index finger region, downwardly beyond the thumb crotch, and through the thumb region; and an imaginary second plane oriented at right angles to the imaginary first plane and extending along the narrowest width of the wrist region; wherein the imaginary second plane intersects the imaginary first plane at an intersection region;

an imaginary third plane is oriented parallel to the imaginary first plane and at right angles to the imaginary second plane, said imaginary third plane passing through the narrowest width of the wrist region;

wherein the imaginary second plane intersects the wrist region's first side at a transition region; and wherein the transition region is located on an opposite side of the imaginary first plane from the imaginary third plane;

wherein the body includes a front and a back of the glove; wherein texture is provided on gripping surfaces of each of the front and the back, and wherein the pattern of texture on the front is identical to the pattern of texture on the back;

wherein the exterior surface of the body is of a first color and the interior surface of the body is of a second color that is different from the first color;

a rolled cuff extends outwardly from the wrist region in a direction opposite to the palm region; and wherein the wrist region terminates at a bottom end and the body has a first length measured from the bottom end to the intersection region and a second length measured from the intersection region to the thumb crutch, and wherein when the glove is laid on a flat surface, the first length is between 79 mm and 97 mm and the second length is between 80 mm and 94 mm, wherein the first length is adapted to cause the wrist region to extend over a long sleeve shirt worn by the person in a cooled meat processing environment.

14. The glove according to claim 13, wherein the transition region is located vertically below the thumb crotch.

15. The glove according to claim 13, wherein when the glove is laid on a flat surface the narrowest width of the glove is between 98.5 mm to 130 mm.

16. The glove according to claim 13, wherein when the glove is laid on the flat surface, a bottom end of the wrist region is of a width of between 127 mm and 150 mm.

17. A glove comprising:

a body defining an interior cavity adapted to receive a person's hand therein, wherein the body is fabricated from one or more of nitrile and natural rubber;

wherein the body includes:

a thumb region adapted to receive the person's thumb therein;

an index finger region adapted to receive the person's index finger therein, wherein the index finger region has a first side that together with a first side of the thumb region defines a thumb crotch therebetween;

a wrist region adapted to receive the person's wrist therein;

wherein the body has an interior surface bounding and defining the interior cavity, and wherein the interior surface is flocked;

an imaginary first plane extending generally along the first side of the index finger region, downwardly beyond the thumb crotch, and through the thumb region;

an imaginary second plane oriented at right angles to the imaginary first plane and extending along a narrowest width of the wrist region; wherein the imaginary first plane and imaginary second plane intersect one another at an intersection region; and an imaginary third plane oriented parallel to the imaginary first plane and at right angles to the imaginary second plane, said imaginary third plane passing through the narrowest width of the wrist region;

wherein the imaginary second plane intersects a first side of the wrist region at a transition region; and wherein the transition region is located outwardly from the intersection region in a direction moving away from the imaginary third plane and towards the imaginary first plane; and wherein the wrist region terminates at a bottom end and the body has a first length measured from the bottom end to the intersection region and a second length measured from the intersection region to the thumb crutch, and wherein when the glove is laid on a flat surface, the first length is between 79 mm and 97 mm and the second length is between 80 mm and 94 mm, wherein the first length is adapted to cause the wrist region to extend over a long sleeve shirt worn by the person in a cooled meat processing environment.

* * * * *